US006435313B2

(12) United States Patent
Tajima et al.

(10) Patent No.: US 6,435,313 B2
(45) Date of Patent: Aug. 20, 2002

(54) CONTROLLER FOR DYNAMICALLY ALLOCATING REGENERATIVE POWER TO A RECHARGEABLE POWER SUPPLY OF AN ELEVATOR

(75) Inventors: Shinobu Tajima; Hiroshi Araki; Ikuro Suga; Kazuyuki Kobayashi, all of Tokyo (JP)

(73) Assignees: Mitsubishi Denki Kabushiki Kaisha; The Tokyo Electric Power Company, Inc., both of Tokyo (JP)

( * ) Notice: Subject to any disclaimer, the term of this patent is extended or adjusted under 35 U.S.C. 154(b) by 0 days.

(21) Appl. No.: 09/785,448

(22) Filed: Feb. 20, 2001

(30) Foreign Application Priority Data

Feb. 28, 2000 (JP) ..... 2000-052344

(51) Int. Cl.[7] ..... B66B 1/06
(52) U.S. Cl. ..... 187/290; 187/296
(58) Field of Search ..... 187/290, 296, 187/247, 277; 318/375, 376; 307/64, 66; 320/128, 132, 134, 135

(56) References Cited

U.S. PATENT DOCUMENTS 3,585,482 A * 6/1971 Zelina ..... 320/39
4,316,097 A * 2/1982 Reynolds ..... 307/66
5,285,029 A * 2/1994 Araki ..... 187/114
5,420,491 A * 5/1995 Kanzaki et al. ..... 318/727
5,698,823 A * 12/1997 Tanahashi ..... 187/296
5,712,456 A * 1/1998 McCarthy et al. ..... 187/290
6,121,740 A * 9/2000 Gale et al. ..... 318/376
6,264,005 B1 * 7/2001 Kang et al. ..... 187/290
6,315,081 B1 * 11/2001 Yeo ..... 187/290

FOREIGN PATENT DOCUMENTS

JP 10-67469 3/1998

* cited by examiner

*Primary Examiner*—Jonathan Salata
(74) *Attorney, Agent, or Firm*—Leydig, Voit & Mayer, Ltd

(57) ABSTRACT

An elevator controller for stably controlling charging and discharging of a power accumulating device by using a cheap secondary battery having a low capacity, without damaging energy saving effects obtained by charging. The controller of the elevator includes a converter for rectifying AC power and converting the AC power to DC power; an inverter for converting the DC power to AC power having a variable voltage and a variable frequency to operate the elevator; a power accumulating device for accumulating DC power from a DC bus in a regenerative operation and supplying the DC power in a power operation; a charging-discharging control circuit for controlling charging and discharging operations of the power accumulating device; a series connecting body, arranged between DC buses, and a gate for regenerative current control and a regenerative resistor; a regenerative control circuit for controlling operation of the gate for regenerative current control; and a charging discharging state measuring device measuring charging and discharging state of the power accumulating device.

11 Claims, 22 Drawing Sheets

FIG. 2

T1

| BATTERY TEMPERATURE | LIMITED CHARGING CURRENT |
|---|---|
| ~ 0 DEGREES | I1 |
| ~ 10 DEGREES | I2 |
| • | • |
| • | • |
| • | • |
| • | • |
| • | • |

FIG. 6

T2

| SOC | LIMITED CHARGING CURRENT |
|---|---|
| ~ 90% | I1 |
| ~ 80% | I2 |
| • | • |
| • | • |
| • | • |
| • | • |
| • | • |

FIG. 9

T3

| CHARGING CURRENT | MAXIMUM CHARGING VOLTAGE |
|---|---|
| ~ $I_1$ | V1 |
| ~ $I_2$ | V2 |
| • | • |
| • | • |
| • | • |
| • | • |
| • | • |

FIG. 12

T4

| BATTERY TEMPERATURE | LIMITED DISCHARGING CURRENT |
|---|---|
| ~ 0 DEGREES | I1 |
| ~ 10 DEGREES | I2 |
| • | • |
| • | • |
| • | • |
| • | • |
| • | • |

FIG. 16

T5

| SOC | LIMITED DISCHARGING CURRENT |
|---|---|
| ~ 90% | I1 |
| ~ 80% | I2 |
| • | • |
| • | • |
| • | • |
| • | • |
| • | • |

FIG. 18

T6

| DISCHARGING CURRENT | MAXIMUM DISCHARGING VOLTAGE |
|---|---|
| I1 | V1 |
| I2 | V2 |
| • | • |
| • | • |
| • | • |
| • | • |
| • | • |

CONTROLLER FOR DYNAMICALLY ALLOCATING REGENERATIVE POWER TO A RECHARGEABLE POWER SUPPLY OF AN ELEVATOR

BACKGROUND OF THE INVENTION

1. Field of the Invention

This invention relates to a controller of an elevator of an energy saving type to which a secondary battery is applied.

2. Description of the Related Art

FIG. 20 is a view showing the basic construction of a controller for controlling the operation of an elevator by applying a conventional secondary battery thereto.

In FIG. 20, reference numerals 1 and 2 respectively designate a three-phase AC power source and a converter constructed by a diode, etc. and converting AC power outputted from the three-phase AC power source 1 to DC power. The DC power converted by the converter 2 is supplied to a DC bus 3. The operation of an inverter 4 is controlled by a speed controller for controlling a speed position of the elevator and described later. A direct current supplied through the DC bus 3 is converted to an alternating current of predetermined desirable variable voltage and variable frequency and an AC motor 5 is driven so that a hoisting machine 6 of the elevator directly connected to the AC motor 5 is rotated. Thus, a rope 7 wound around the hoisting machine 6 controls elevating and lowering operations of a car 8 and a counterweight 9 connected to both ends of this rope 7 and passengers within the car 8 are moved to a predetermined stage floor.

Here, weights of the car 8 and the counterweight 9 are designed such that these weights are approximately equal to each other when passengers half a number limit ride in the car 8. Namely, when the car 8 is elevated and lowered with no load, a power running operation is performed at a lowering time of the car 8 and a regenerative operation is performed at a elevating time of the car 8. Conversely, when the car 8 is lowered in the number limit riding, the regenerative operation is performed at the lowering time of the car 8 and the power running operation is performed at the elevating time of the car 8.

An elevator control circuit 10 is constructed by a microcomputer, etc., and manages and controls an entire operation of the elevator. A power accumulating device 11 is arranged between DC buses 3 and accumulates power at the regenerative operation time of the elevator, and supplies the accumulated power to the inverter 4 together with the converter 2 at the power running operation time. The power accumulating device 11 is constructed by a secondary battery 12 and a DC-DC converter 13 for controlling charging and discharging operations of this secondary battery 12.

Here, the DC-DC converter 13 has a voltage lowering type chopper circuit and a voltage raising type chopper circuit. The voltage lowering type chopper circuit is constructed by a reactor 13*a*, a gate 13*b* for charging current control connected in series to this reactor 13*a*, and a diode 13*c* connected in reverse parallel to a gate 13*d* for discharging current control described later. The voltage raising type chopper circuit is constructed by the reactor 13*a*, the gate 13*d* for discharging current control connected in series to this reactor 13*a*, and a diode 13*e* connected in reverse parallel to the above gate 13*b* for charging current control. Operations of the gate 13*b* for charging current control and the gate 13*d* for discharging current control are controlled by a charging-discharging control circuit 15 on the basis of a measuring value from a charging-discharging state measuring device 14 for measuring charging and discharging states of the power accumulating device 11 and a measuring value from a voltage measuring instrument 18. A current measuring instrument arranged between the secondary battery 12 and the DC-DC converter 13 is used as the charging-discharging state measuring device 14 in this conventional example.

A gate 16 for regenerative current control and a regenerative resistor 17 are arranged between DC buses 3. The voltage measuring instrument 18 measures the voltage of a DC bus 3. A regenerative control circuit 19 is operated on the basis of regenerative control commands from a speed control circuit described later. The gate 16 for regenerative current control is constructed such that an ON pulse width is controlled on the basis of control of the regenerative control circuit 19 when a measuring voltage provided by the voltage measuring instrument 17 is equal to or greater than a predetermined value at the regenerative operation time. Regenerated power is discharged in the regenerative resistor 17 and is converted to thermal energy and is consumed.

An encoder 20 is directly connected to the hoisting machine 6. The speed control circuit 21 controls a position and a speed of the elevator by controlling an output voltage and an output frequency of the inverter 4 on the basis of speed commands and a speed feedback output from the encoder 22 based on commands from the elevator control circuit 10.

An operation of the controller having the above construction will next be explained.

At a power running operation time of the elevator, power is supplied to the inverter 4 from both the three-phase AC power source 1 and the power accumulating device 11. The power accumulating device 11 is constructed by the secondary battery 12 and the DC-DC converter 13, and an operation of this power accumulating device 11 is controlled by the charging-discharging control circuit 15. In general, the number of secondary batteries 12 is reduced as much as possible and an output voltage of each secondary battery 12 is lower than the voltage of the DC bus 3 so as to make the controller compact and cheaply construct the controller. The voltage of the DC bus 3 is basically controlled near a voltage provided by rectifying a three-phase AC of the three-phase AC power source 1. Accordingly, it is necessary to lower the bus voltage of the DC bus 3 at a charging time of the secondary battery 12 and raise the bus voltage of the DC bus 3 at a discharging time of the secondary battery 12. Therefore, the DC-DC converter 13 is adopted. Operations of the gate 13*b* for charging current control and the gate 13*d* for discharging current control in this DC-DC converter 13 are controlled by the charging-discharging control circuit 15.

FIGS. 21 and 22 are flow charts showing controls of the charging-discharging control circuit 15 at its discharging and times.

The control of the charging-discharging control circuit 15 at the discharging time shown in FIG. 21 will first be explained.

A current control minor loop, etc. are constructed in voltage control of a control system and the control operation may be more stably performed. However, for simplicity, the control of the charging-discharging control circuit 15 is here explained by a control system using the bus voltage.

First, the bus voltage of the DC bus 3 is measured by the voltage measuring instrument 17 (step S11). The charging-discharging control circuit 15 compares this measuring voltage with a predetermined desirable voltage set value and judges whether the measuring voltage exceeds the voltage set value or not (step S12). If no measuring voltage exceeds the set value, the charging-discharging control circuit 15 next judges whether the measuring value of a discharging current of the secondary battery 12 provided by the charging-discharging state measuring device 14 exceeds a predetermined value or not (step S13).

When the measuring voltage exceeds the set value by these judgments, or when the measuring value of the discharging current of the secondary battery 12 exceeds the predetermined value even if no measuring voltage exceeds the set value, an adjusting time DT is subtracted from the present ON time to shorten an ON pulse width of the gate 13*d* for discharging current control and a new gate ON time is calculated (step S14).

In contrast to this, when it is judged in the above step S13 that no measuring value of the discharging current of the secondary battery 12 provided by the measuring device 14 exceeds the predetermined value, a new gate ON time is calculated by adding the adjusting time DT to the present ON time so as to lengthen the ON pulse width of, the gate 13*d* for discharging current control (step S15). Thus, ON control of the gate 13*d* for discharging current control is performed on the basis of the calculated gate ON time, and the calculated gate ON time is stored to a built-in memory as the present ON time (step S16).

Thus, a more electric current flows from the secondary battery 12 by lengthening the ON pulse width of the gate 13*d* for discharging current control. As a result, supply power is increased and the bus voltage of the DC bus 3 is increased by the power supply. When the power running operation is considered, the elevator requires the power supply and this power is supplied by discharging from the above secondary battery 12 and power supply from the three-phase AC power source 1. When the bus voltage is controlled such that this bus voltage is higher than an output voltage of the converter 2 supplied from the three-phase AC power source 1, all power is supplied from the secondary battery 12. However, the controller is designed such that all power is not supplied from the secondary battery 12, but is supplied from the secondary battery 12 and the three-phase AC-power source 1 in a suitable ratio so as to cheaply construct the power accumulating device 11.

Namely, in FIG. 21, the measuring value of the discharging current is compared with a supply allotment corresponding current (predetermined value). If this measuring value exceeds the predetermined value, the ON pulse width of the gate 13*d* for discharging current control is lengthened and a supply amount is further increased. In contrast to this, when no measuring value of the discharging current exceeds the predetermined value, the ON pulse width of the gate 13*d* for discharging current control is shortened and: the power supply is clipped. Thus, since power supplied from the secondary battery 12 is clipped among power required in the inverter 4, the bus voltage of the DC bus 3 is reduced so that the power supply from the converter 2 is started. These operations are performed for a very short time so that a suitable bus voltage is actually obtained to supply required power of the elevator. Thus, power can be supplied from the secondary battery 12 and the three-phase AC power source 1 in a predetermined desirable ratio.

The control of the charging-discharging control circuit 15 at the charging time shown in FIG. 22 will next be explained.

When there is power regeneration from the AC motor 5, the bus voltage of the DC bus 3 is increased by this regenerated power. When this voltage is higher than an output voltage of the converter 2, the power supply from the three-phase AC power source 1 is stopped. When there is no power accumulating device 11 and this stopping state is continued, the voltage of the DC bus 3 is increased. Therefore, when a measuring voltage value of the voltage measuring instrument 17 for detecting the bus voltage of the DC bus 3 reaches a certain predetermined voltage, the regenerative control circuit 19 is operated and closes the gate 16 for regenerative current control. Thus, power flows through the regenerative resistor 17 and the regenerated power is consumed and the elevator is decelerated by electromagnetic braking effects. However, when there is the power accumulating device 11, this power is charged to the power accumulating device 11 by the control of the charging-discharging control circuit 15 with a voltage equal to or smaller-than a predetermined voltage.

Namely, as shown in FIG. 22, if the measuring value of the bus voltage of the DC bus 3 provided by the voltage measuring instrument 17 exceeds the predetermined voltage, the charging-discharging control circuit 15 detects that it is a regenerative state, and increases a charging current to the secondary battery 12 by lengthening the ON pulse width of the gate 13*b* for charging current control (step S21→S22→S23). When the regenerated power from the elevator is reduced in a short time, the voltage of the DC bus 3 is also correspondingly reduced and no measuring value of the voltage measuring instrument 17 exceeds the predetermined voltage. Accordingly, the ON pulse width of the gate 13*b* for charging current control is shortly controlled and charging power is also reduced and controlled (step S21→S22→S24).

Thus, the bus voltage is controlled in a suitable range and a charging operation is performed by monitoring the bus voltage of the DC bus 3 and controlling the charging power. Further, energy is saved by accumulating and re-utilizing power conventionally consumed in the regenerated power. When no power of a charger is consumed for certain reasons such as a breakdown, etc., the above regenerative control circuit 19 is operated as a backup and the regenerated power is consumed by a resistor so that the elevator is suitably decelerated. In a general elevator for housing, the regenerated power is about 2 KVA and is about 4 KVA at its maximum decelerating value although this regenerated power is different in accordance with a capacity of the elevator, etc.

The regenerative control circuit 19 monitors the voltage of the DC bus 3. If this voltage is equal to or greater than a predetermined value, the ON pulse width of the gate 16 for regenerative current control is controlled by the regenerative control circuit 19 so as to discharge the above power in the regenerative resistor 17 so that the regenerated power flows through the regenerative resistor 17. There are various kinds of systems for controlling this pulse width, but the pulse width is simply controlled in accordance with the following formula. Namely, when the voltage of the DC bus 3 for starting turning-on of the gate 16 for regenerative current control is set to VR, a flowing current IR can be simply calculated by turning-on (closing) a circuit since a resistance value of the regenerative resistor 17 is already known. Further, maximum power to be flowed is already known. Therefore, if this maximum power (VA) is set to WR, it is sufficient to generate an ON pulse of duty of WR/(VR×IR) while the DC bus voltage is monitored. However, an object of this construction is to consume all regenerated power in the regenerative resistor 17.

However, in the above conventional controller of the elevator, it is necessary to stack the secondary battery 12 to produce a large capacity able to be charged by the regenerated power in the power accumulating device 11 in all conditions of temperature and charging degree of the power accumulating device 11, i.e., a full charging state of the power accumulating device 11, are set to reference values and a product of a charging-discharging current by a charging-discharging voltage is normalized and accumulated, and a SOC (State Of Charge) is obtained as this normalized and accumulated value, etc. Therefore, an expensive and large sized power accumulating device 11 is required.

SUMMARY OF THE INVENTION

To solve the above problems, an object of this invention is to provide a controller of an elevator able to stably control charging and discharging operations of a power accumulating device by using a cheap secondary battery of a low capacity without damaging energy saving effects provided by charging.

To achieve this object, a controller of an elevator in this invention comprises a converter for rectifying AC power from an AC power source and converting the AC power to DC power; an inverter for converting the DC power to AC power of a variable voltage and a variable frequency and driving an electric motor and operating the elevator; a power accumulating device arranged between DC buses between the converter and the inverter, and accumulating DC power from the DC buses at a regenerative operation time of the elevator and supplying the DC power accumulated on the DC buses at a power running operation time; charging-discharging control means for controlling charging and discharging operations of the power accumulating device with respect to the DC buses; bus voltage measuring means for measuring a bus voltage of each of the DC buses; and charging-discharging state measuring means for measuring charging and discharging states of the power accumulating device; the charging-discharging control means controlling the charging and discharging operations of the power accumulating device according to a measuring value from the bus voltage measuring means and a measuring value from the charging-discharging state measuring means.

Further, the charging-discharging control means has a table setting a limited charging current with respect to temperature, and the limited charging current corresponding to a measuring value of the temperature from the table calculated. from the charging-discharging state measuring means on the basis of the measuring value of the temperature, and the charging current supplied to the power accumulating device is controlled on the basis of the comparison of a measuring value of the charging current from the charging-discharging state measuring means and the limited charging current.

Further, the charging-discharging control means has plural tables each according to a charging degree as a value obtained by normalizing and accumulating a product of a charging-discharging current and a charging-discharging voltage by a capacity with a full charging state of the power accumulating device as a reference, and selects a table according to the charging degree.

Further, the charging-discharging control means has a table in which a limited charging current is set with respect to a charging degree as a value obtained by normalizing and accumulating a product of a charging-discharging current and a charging-discharging voltage by a capacity with a full charging state of the power accumulating device as a reference, and the charging-discharging control means calculates the limited charging current corresponding to a value of the charging degree based on the measuring value from the charging-discharging state measuring means, and controls the charging current supplied to the power accumulating device on the basis of the comparison of a measuring value of the charging current and the limited charging current.

Further, the charging-discharging control means controls a charging current supplied to the power accumulating device on the basis of the comparison of a measuring value of the charging current from the charging-discharging state measuring means and a maximum charging current set value.

Further, the charging-discharging control circuit has a table setting a maximum charging voltage with respect to a charging current, and calculates a set value of the maximum charging voltage corresponding to a measuring value of the charging current from the charging-discharging state measuring means, and controls the charging current supplied to the power accumulating device on the basis of the comparison of a measuring value of the charging voltage and the set value of the maximum charging voltage.

Further, the controller further comprises speed control means for controlling a speed of the elevator by controlling an output voltage and an output frequency of the inverter, and the charging-discharging control means controls a discharging current of the power accumulating device on the basis of the measuring value from the bus voltage measuring means, the measuring value from the charging-discharging state measuring means, and speed commands from the speed control means.

Further, the charging-discharging control means has a table setting a limited discharging current with respect to temperature, and calculates the limited discharging current corresponding to a measuring value of the temperature from the charging-discharging state measuring means, and controls the discharging current supplied to the power accumulating device on the basis of the comparison of a measuring value of the discharging current and the limited discharging current.

Further, the charging-discharging control means has plural tables each according to a charging degree as a value obtained by normalizing and accumulating a product of a charging-discharging current and a charging-discharging voltage by a capacity with a full charging state of the power accumulating device as a reference, and selects a table according to the charging degree based on the measuring value from the charging-discharging state measuring-means.

Further, the charging-discharging control means has a table in which a limited discharging current is set with respect to a charging degree as a value obtained by normalizing and accumulating a product of a charging-discharging current and a charging-discharging voltage by a capacity with a full charging state of the power accumulating device as a reference, and the charging-discharging control means calculates the limited discharging current corresponding to the value of the charging degree based on the measuring value from the charging-discharging state measuring means, and controls the discharging current supplied to the power accumulating device on the basis of the comparison of a measuring value of the discharging current and the limited discharging current.

Further, the charging-discharging control means has a table setting a maximum discharging voltage with respect to the discharging current, and calculates a set value of the maximum discharging voltage corresponding to a measuring value of the discharging current from the charging-discharging state measuring means, and controls the discharging current supplied to the power accumulating device on the basis of the comparison of a measuring value of the discharging voltage and the set value of the maximum discharging voltage.

BRIEF DESCRIPTION OF THE DRAWINGS

FIG. 2 is an explanatory view of a table in a charging-discharging control circuit in an embodiment 1 of this invention.

FIG. 6 is an explanatory view of a table in a charging-discharging control circuit in an embodiment 3 of this invention.

FIG. 9 is an explanatory view of a table in a charging-discharging control circuit in an embodiment 5 of this invention.

FIG. 12 is an explanatory view of a table in a charging-discharging control circuit in an embodiment 7 of this invention.

FIG. 16 is an explanatory view of a table in a charging-discharging control circuit in an embodiment 9 of this invention.

FIG. 18 is an explanatory view of a table in a charging-discharging control circuit in an embodiment 10 of this invention.

DETAILED DESCRIPTION OF THE PREFERRED EMBODIMENTS

In this invention, regenerative power is charged to a power accumulating device as much as possible to secure energy saving effects, but it is controlled such that no power accumulating device is excessively charged to protect the charging ability of a battery and secure a battery life.

Namely, in this invention, an elevator having a power accumulating device having a long battery life is provided, by measuring a bus voltage and charging and discharging states of the power accumulating device, and controlling charging and discharging operations in accordance with measuring values.

Characteristics of the secondary battery used in the power accumulating device are different from each other according to the kinds of the battery such as a lead battery, a nickel hydrogen battery, etc. However, in general, no charging operation is efficiently performed in states in which temperature is lower and higher than a normal temperature. Further, when a charging degree is high (approaches a full charge), charging reception of course is not efficiently performed. When a large electric current is charged in such bad charging reception states, not only does an increase in internal resistance, i.e., increases in heating of the battery and charging voltage occur but subsequent charging performance is further deteriorated. Therefore, it is necessary to control so as to avoid excessively charging the secondary battery as much as possible.

Figure 1:
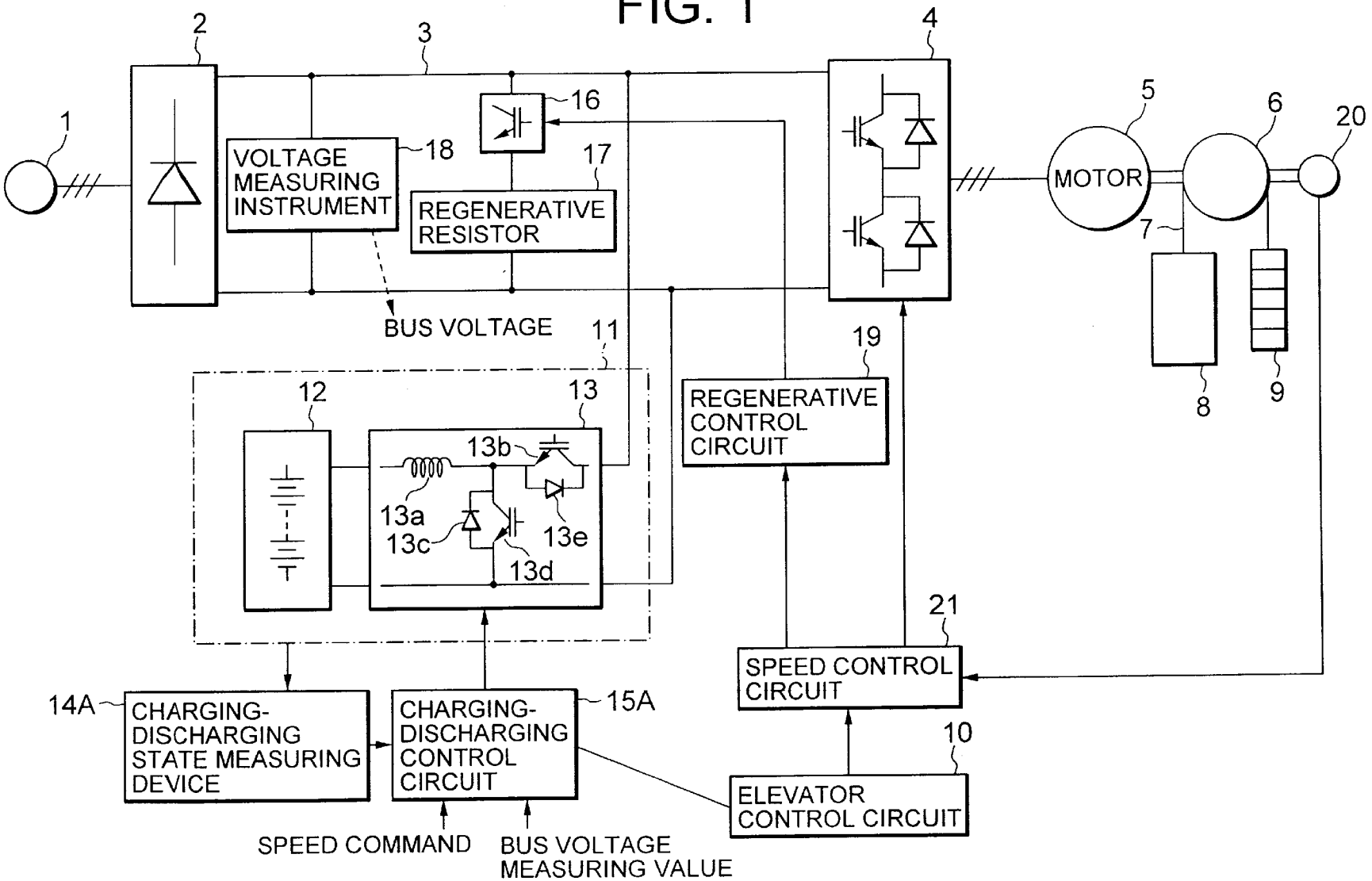
FIG. 1 is a block diagram showing the construction of a control of an elevator in this invention.
Figure 20:
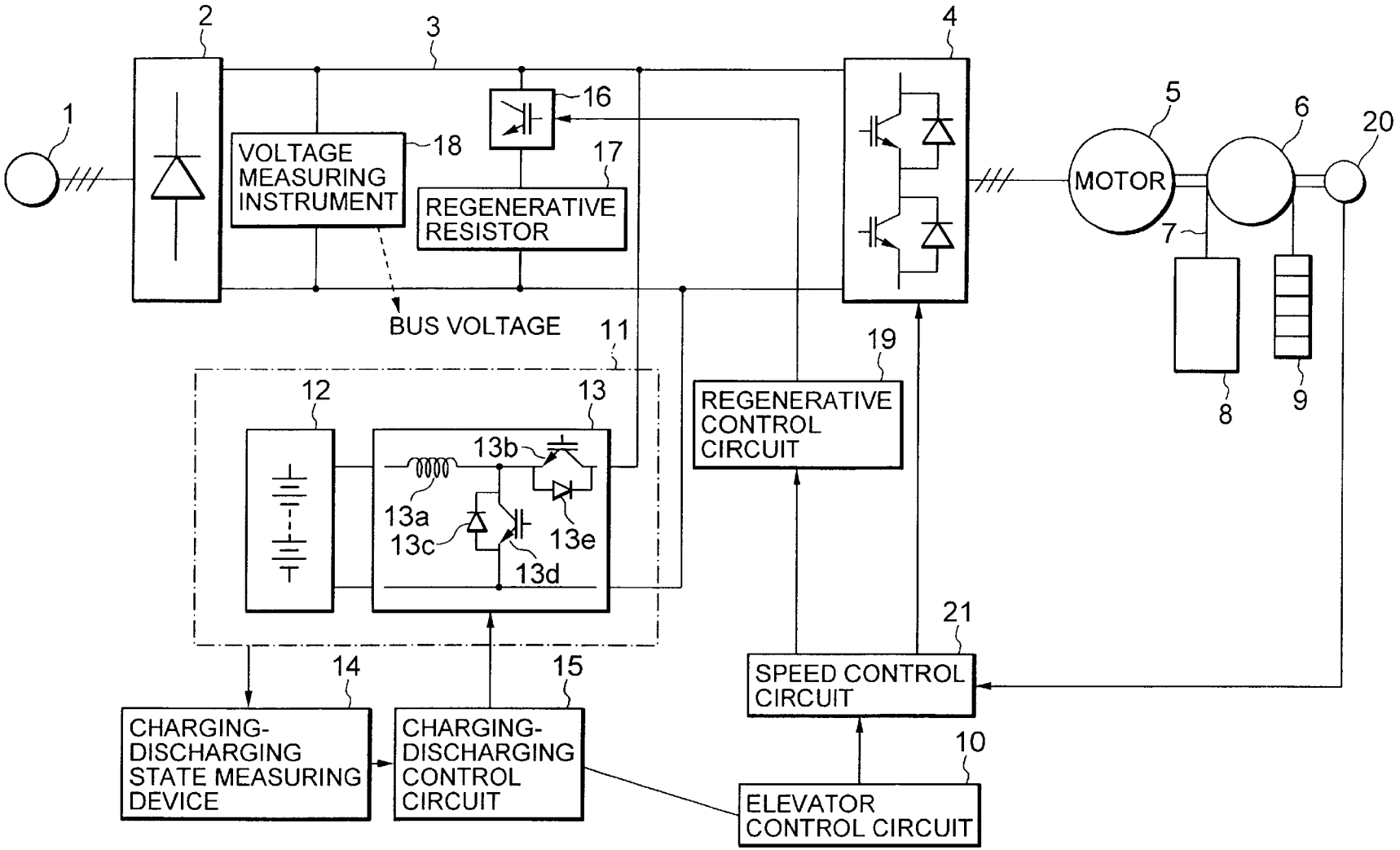
FIG. 20 is a block diagram showing the construction of a controller of an elevator in a conventional example.
Figure 21:
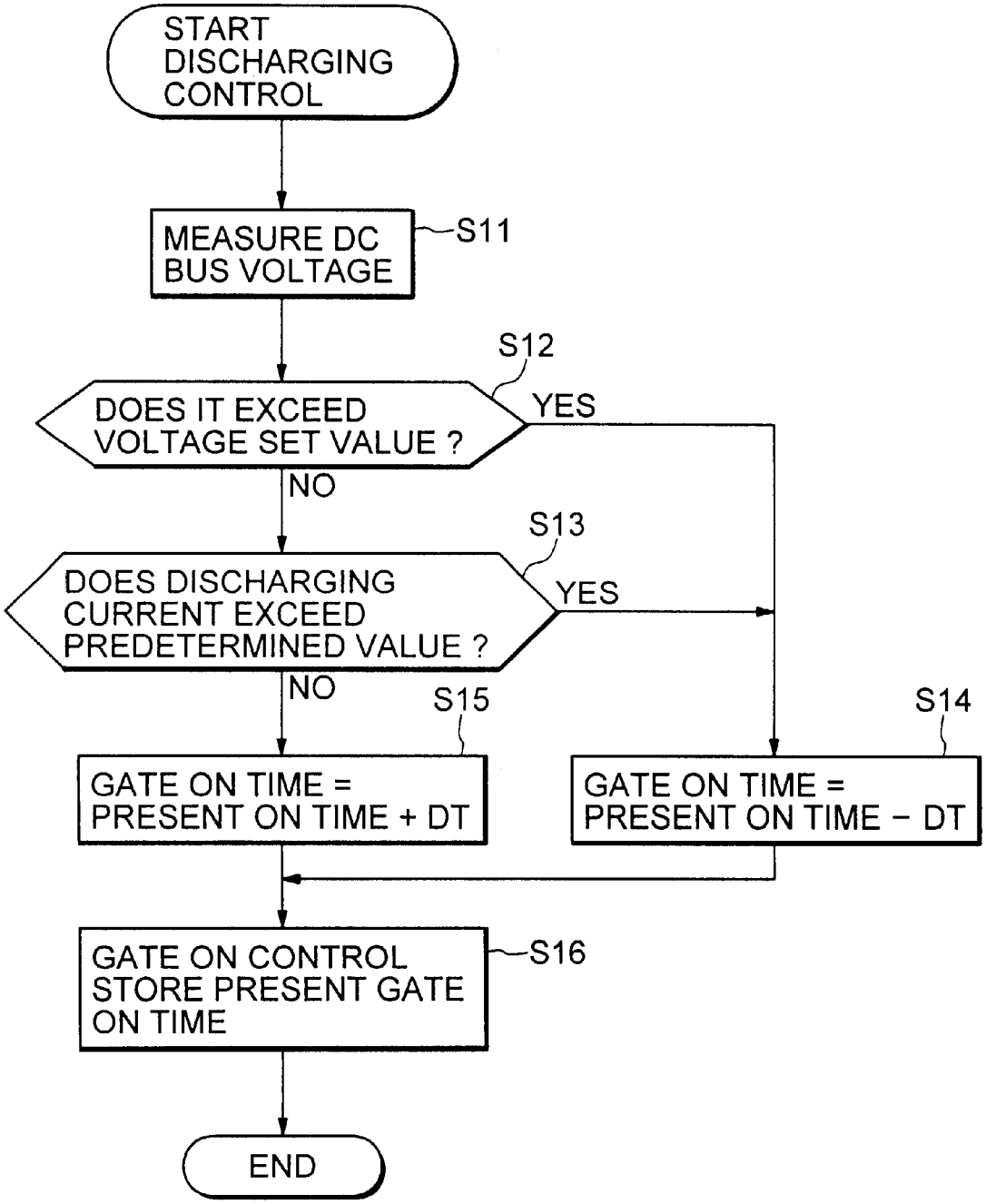
FIG. 21 a flow chart showing the control of a charging-discharging control circuit shown in FIG. 20 during discharging.
Figure 22:
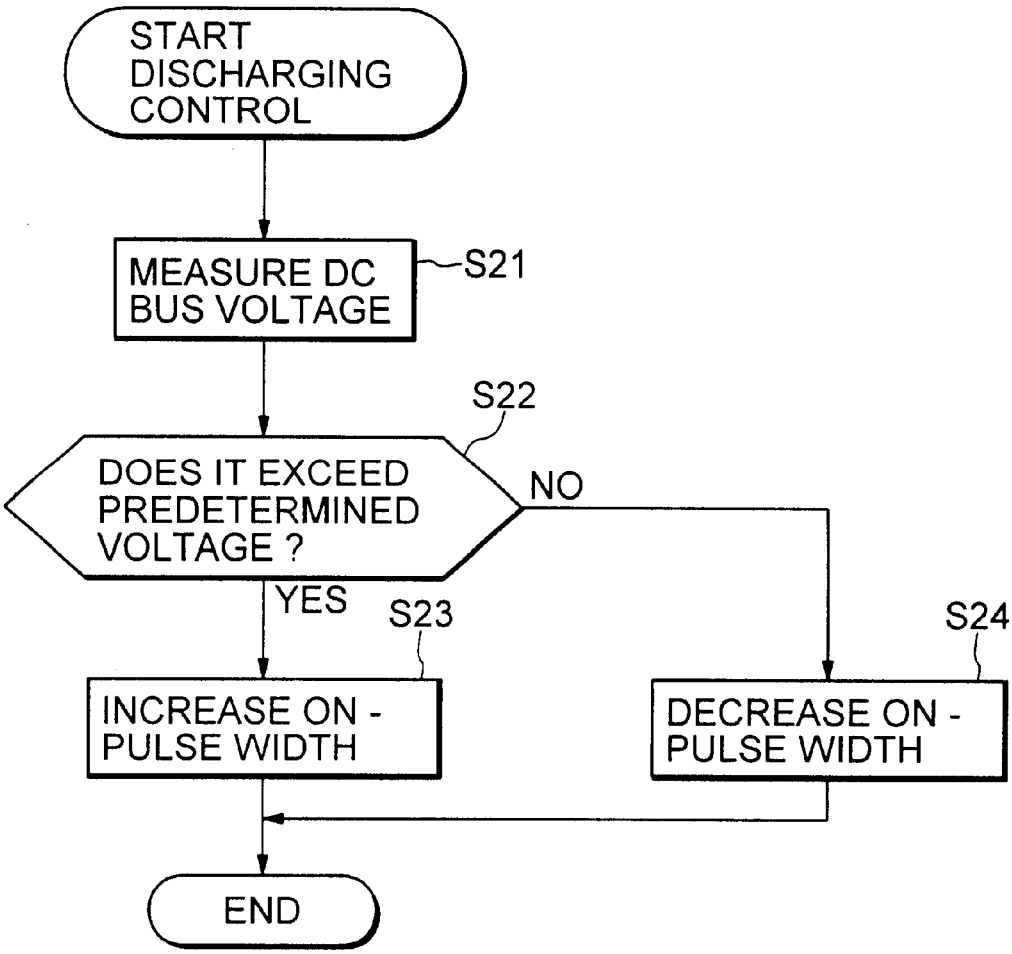
FIG. 22 is a flow chart showing the control of the charging-discharging control circuit shown in FIG. 20 during charging.

FIG. 1 is a block diagram showing the structure of a controller of an elevator in this invention. In FIG. 1, the same components as the conventional example shown in FIG. 20 are designated by the same reference numerals and their explanations are omitted here. New reference numerals 14A and 15A, respectively, designate a charging-discharging state measuring device and a charging-discharging control circuit in the present invention. The charging-discharging state measuring device 14A has each of measuring instruments for measuring charging and discharging currents, charging and discharging voltages and temperature of a power accumulating device 11, and output each of their measuring values and a charging degree SOC to the charging-discharging control circuit 15A. The charging-discharging control circuit 15A controls charging and discharging of the power accumulating device 11 on the basis of a bus voltage measuring value from a voltage measuring instrument 18, the measuring values from the above charging-discharging state measuring device 14A and speed commands from a speed control circuit 21.

Concrete embodiments will next be explained.

Embodiment Mode 1

In this embodiment mode 1, the charging-discharging control circuit 15A has a table T1 in which a limited charging current with respect to the temperature of a secondary battery 12 of the power accumulating device 11 is set, as shown in FIG. 2. A measuring value of the temperature of the secondary battery 12 of the power accumulating device 11 is inputted from the charging-discharging state measuring device 14A to the charging-discharging control circuit 15A. The charging-discharging control circuit 15A calculates the limited charging current corresponding to the inputted measuring value of the temperature from the above table T1. Further, the charging-discharging control circuit 15A controls a charging current supplied to the power accumulating device 11 on the basis of the comparison of a measuring value of the charging current from the above charging-discharging state measuring device 14A and the limited charging current.

Figure 3:
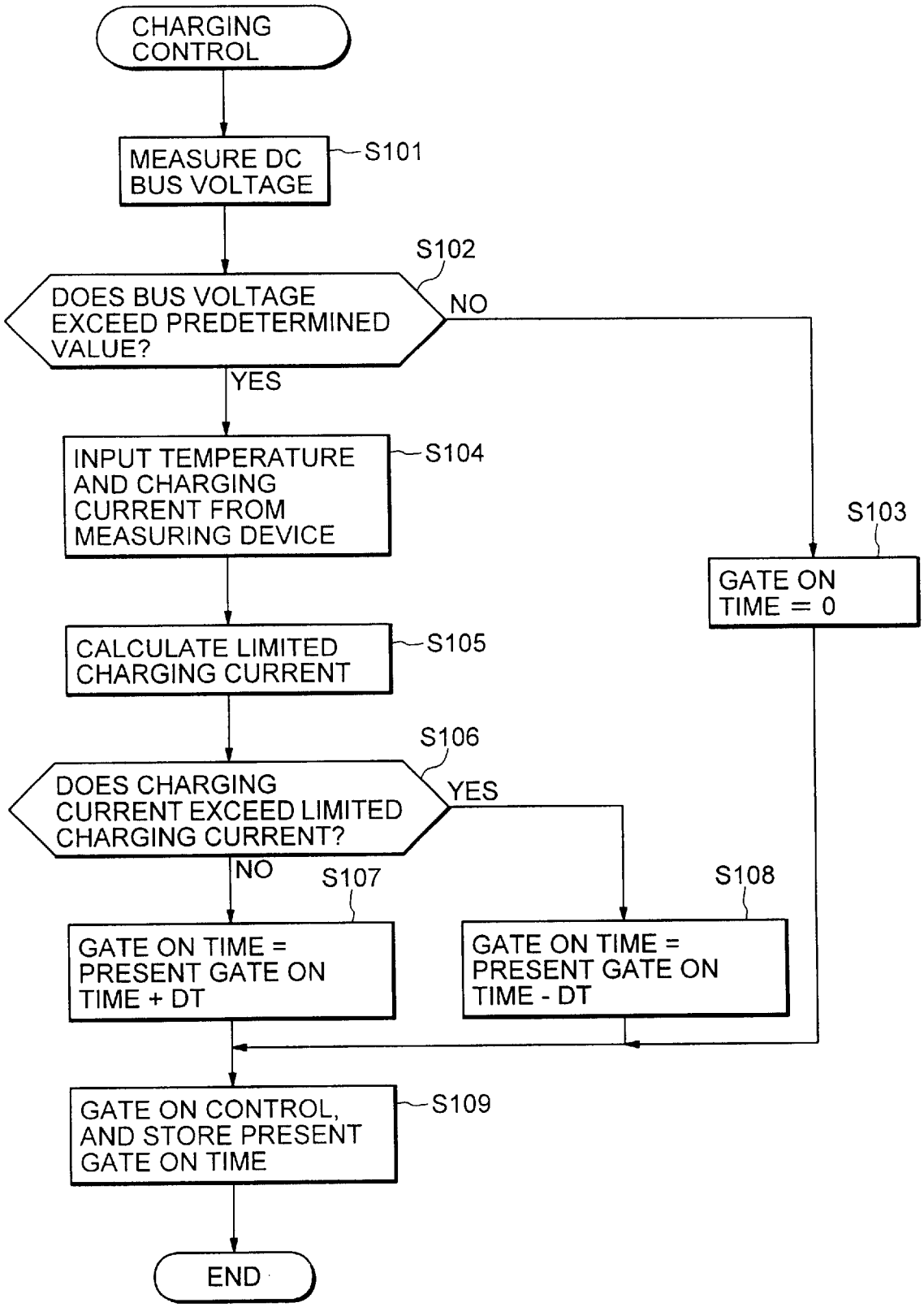
FIG. 3 is a flow chart showing charging control contents of the charging-discharging control circuit in the embodiment 1 of this invention.

Control of the charging-discharging control circuit 15A in the embodiment mode 1 of this invention will next be explained with reference to a flow chart shown in FIG. 3.

The charging-discharging control circuit 15A first confirms the voltage of a DC bus 3 on the basis of a measuring value from the voltage measuring instrument 18. The charging-discharging control circuit 15A also confirms a regenerative state and a power running state of the elevator by this bus voltage, and judges whether the bus voltage exceeds a predetermined value or not (steps S101, S102). If bus voltage does not exceed the predetermined value, charging operation is not performed because the power running state is set. A gate ON time of a gate 13*b* for charging current control of a DC-DC converter 13 of the power accumulating device 11 is controlled and set to 0 (step S102→S103).

In contrast to this, when the bus voltage is higher than the predetermined value, a regenerative operation is performed. In this case, a control operation is performed such that the secondary battery 12 is charged. First, a temperature measuring value and a charging current of the secondary battery 12 of the power accumulating device 11 are read from the charging-discharging state measuring device 14A, and a limited value of the charging current corresponding to the temperature measuring value, i.e., a limited charging current is calculated from the table T1 shown in FIG. 2 (step S102→S104, S105). Since no function of the temperature and the limited charging current is generally a linear function, a table calculated from an experiment, etc. is provided, and the limited charging current is calculated by primary interpolation, etc.

Thereafter, it is judged whether the present charging current provided from the charging-discharging state measuring device 14A, exceeds the calculated limited charging current or not. If present charging current does not exceed the limited charging current, an adjusting time DT is added to the present ON time and a new gate ON time of the gate 13*b* for charging current control is calculated, to further increase the charging current, so that an ON pulse width is increased (steps S106, S107).

In contrast to this, if the present charging current exceeds the limited charging current, the adjusting time DT is subtracted from the present ON time and a new gate ON time of the gate 13*b* for charging current control is calculated so that the ON pulse width is narrowed and the charging current is reduced (step S106→S108). Thus, ON control of the gate 13*b* for charging current control is performed on the basis of the calculated gate ON time, as well as storing the calculated gate ON time to a built-in memory as the present gate ON time to prepare for the next adjustment of the gate ON time (step S109).

Therefore, in accordance with the above embodiment mode 1, when regenerative power is charged to the power accumulating device 11, stable charging control can be performed in a range in which no excessive burden is imposed on the secondary battery 12. Accordingly, a cheap power accumulating device having high energy saving efficiency can be constructed.

Embodiment mode 2

Figure 4:
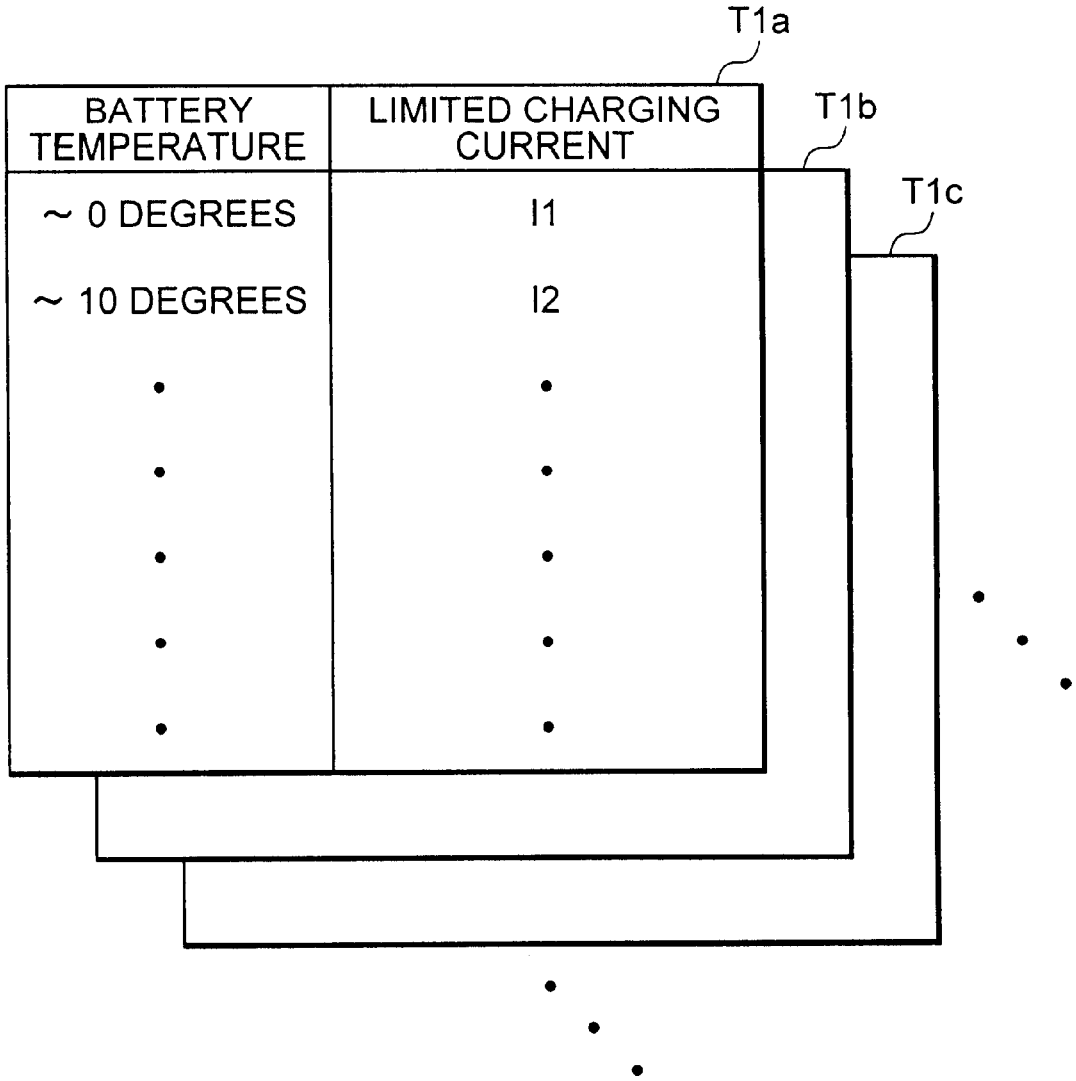
FIG. 4 is an explanatory view of plural tables in a charging-discharging control circuit in an embodiment 2 of this invention.

In this embodiment mode 2, as shown in FIG. 4, the charging-discharging control circuit 15A has plural tables T1*a*, T1*b*, T1*c*, . . . in which a limited charging current with respect to the temperature of the secondary battery 12 of the power accumulating device 11 is set in accordance with a charging degree SOC of the secondary battery 12 of the power accumulating device 11. A measuring value of the temperature and the charging degree SOC of the secondary battery 12 of the power accumulating device 11 are inputted from the charging-discharging state measuring device 14A to the charging-discharging control circuit 15A. The charging-discharging control circuit 15A then selects a table according to the charging degree SOC from the plural tables, and calculates the limited charging current corresponding to the inputted measuring value of the temperature from the selected table. Further, the charging-discharging control circuit 15A controls the charging current supplied to the power accumulating device 11 on the basis of the comparison of a measuring value of the charging current from the above charging-discharging state measuring device 14A and the limited charging current.

Figure 5:
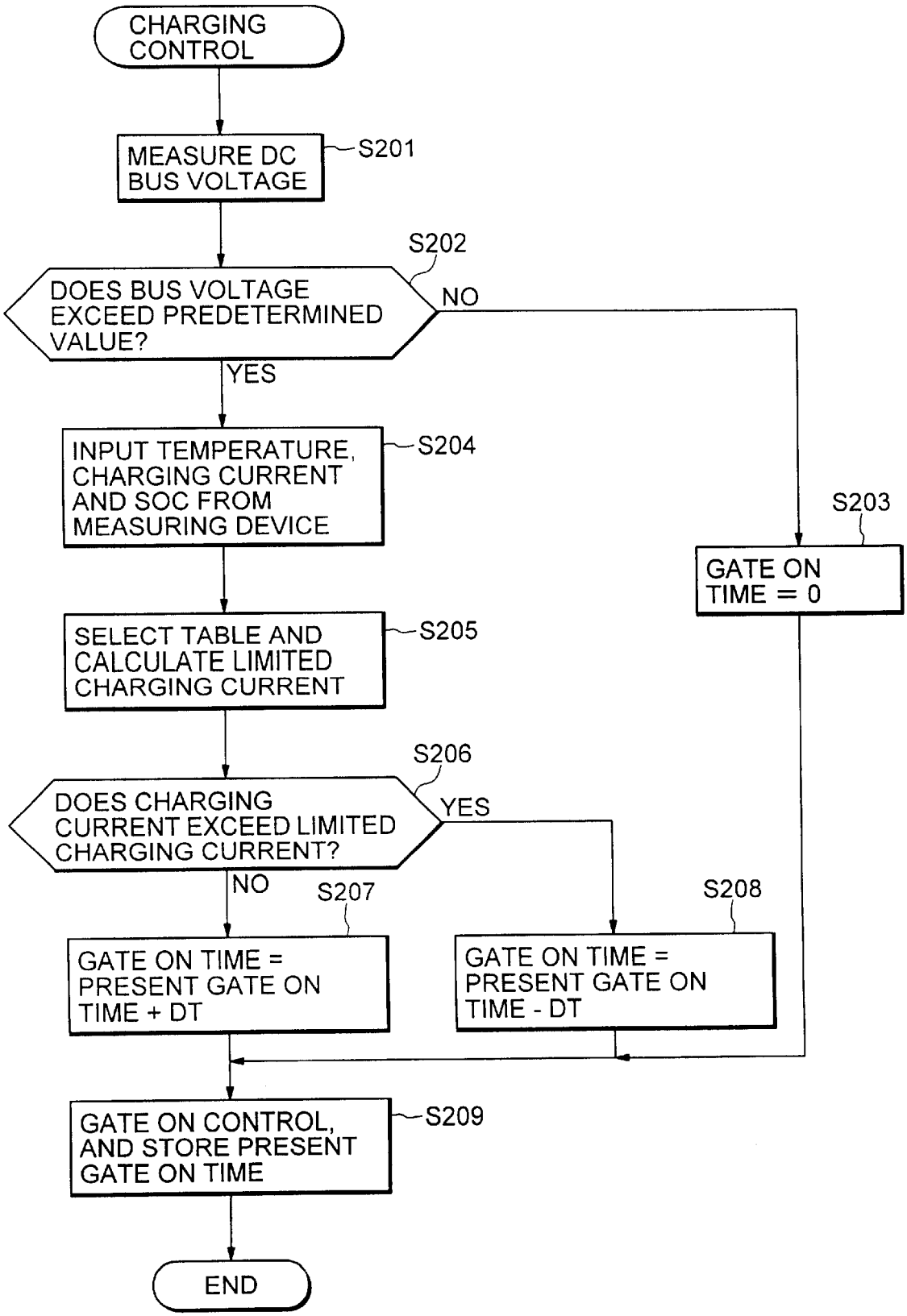
FIG. 5 is a flow chart showing charging control contents of the charging-discharging control circuit in the embodiment 2 of this invention.
Figure 7:
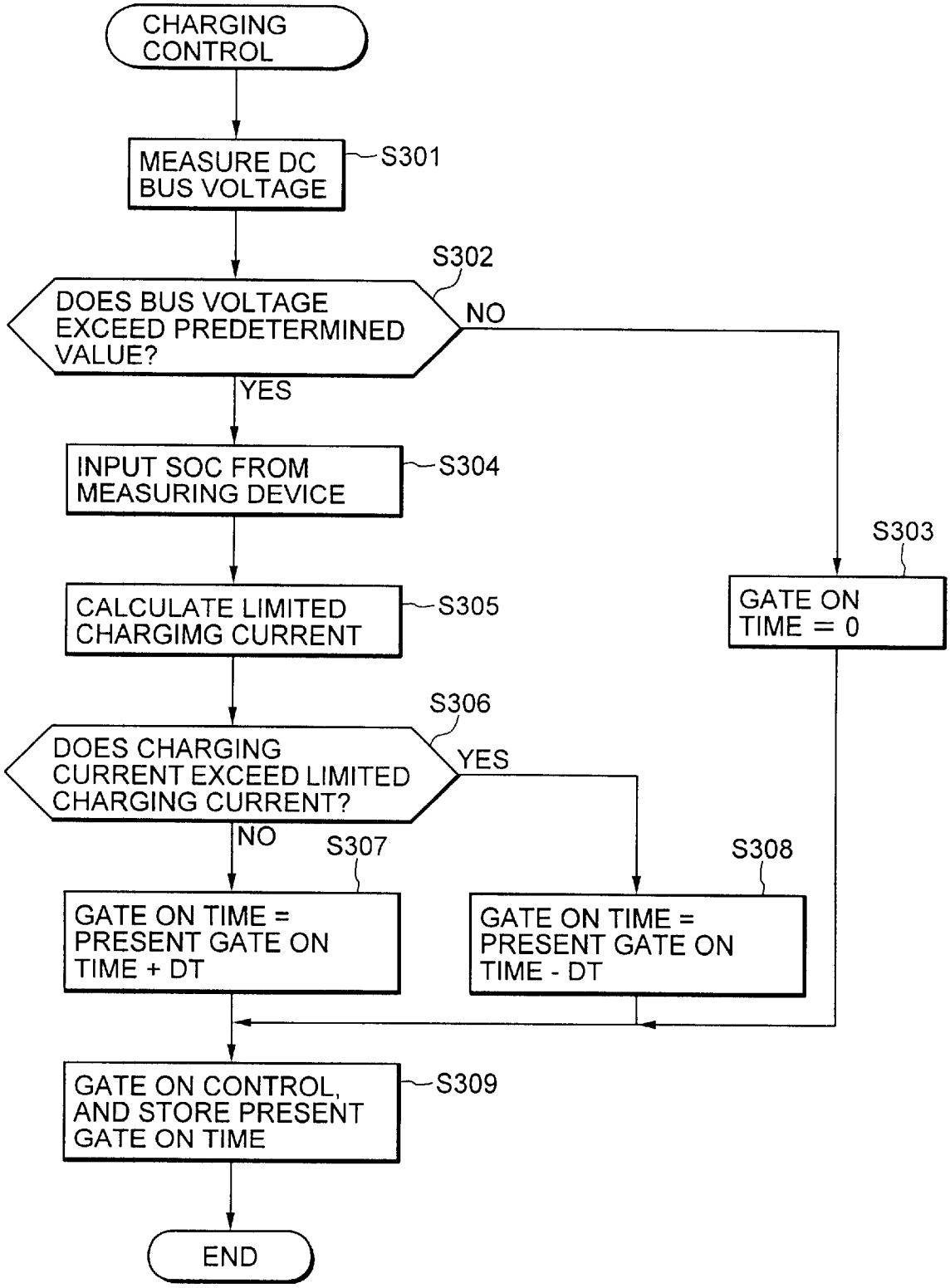
FIG. 7 is a flow chart showing charging control contents of the charging-discharging control circuit in the embodiment 3 of this invention.

Control of the charging-discharging control circuit 15A in the embodiment mode 2 of this invention will next be explained with reference to a flow chart shown in FIG. 5.

First, the charging-discharging control circuit 15A confirms the voltage of a DC bus 3 on the basis of a measuring value from the voltage measuring instrument 18. The charging-discharging control circuit 15A also confirms a regenerative state and a power running state of the elevator by this bus voltage, and judges whether the bus voltage exceeds a predetermined value or not (steps S201, S202). If bus voltage does not exceed the predetermined value, no charging operation is performed because the power running state is set. A gate ON time of the gate 13*b* for charging current control of the DC-DC converter 13 of the power accumulating device 11 is controlled and set to 0 (step S202→S203).

In contrast to this, when the bus voltage is higher than the predetermined value, a regenerative operation is performed. In this case, a control operation is performed such that the secondary battery 12 is charged. First, a temperature measuring value, a charging current and a charging degree SOC of the secondary battery 12 of the power accumulating device 11 are read from the charging-discharging state measuring device 14A. A table according to the charging degree SOC is selected from the plural tables, and a limited charging current corresponding to the temperature measuring value is calculated from the selected table (step S202→S204, S205). In general, charging current is not efficiently received in a high charging degree SOC state. Accordingly, it is desirable to reduce and limit the charging current when the charging degree SOC exceeds a certain level.

Thereafter, it is judged whether the present charging current given from the charging-discharging state measuring device 14A exceeds the calculated limited charging current or not. If present charging current does not exceed the limited charging current, an adjusting time DT is added to the present ON time and a new gate ON time of the gate 13*b* for charging current control is calculated, to further increase the charging current, so that an ON pulse width is increased (steps S206, S207).

In contrast to this, if the present charging current exceeds the limited charging current, the adjusting time DT is subtracted from the present ON time and a new gate ON time of the gate 13*b* for charging current control is calculated, so that the ON pulse width is narrowed, and the charging current is reduced (step S206→S208). Thus, ON control of the gate 13*b* for charging current control is performed on the basis of the calculated gate ON time, as well as storing the calculated gate ON time to a built-in memory as the present gate ON time to prepare for the next adjustment of the gate ON time (step S209).

Therefore, in accordance with the above embodiment mode 2, similar to the embodiment mode 1, when regenerative power is charged to the power accumulating device 11, stable charging control can be performed, in consideration of the charging degree SOC, in a range in which no excessive burden is imposed on the secondary battery 12. Accordingly, a cheap power accumulating device having high energy saving efficiency can be constructed.

Embodiment Mode 3

In this embodiment mode 3, the charging-discharging control circuit 15A has a table T2, in which a limited charging current with respect to a charging degree SOC of the secondary battery 12 of the power accumulating device 11 is set, as shown in FIG. 6. The charging degree SOC of the secondary battery 12 of the power accumulating device 11 is inputted from the charging-discharging state measuring device 14A to the charging-discharging control circuit 15A. The charging-discharging control circuit 15A then calculates the limited charging current according to the charging degree SOC from the table T2. Further, the charging discharging control circuit 15A controls the charging current supplied to the power accumulating device 11 on the basis of the comparison of a measuring value of the charging current from the above charging-discharging state measuring device 14A and the limited charging current.

Control of the charging-discharging control circuit 15A in the embodiment mode 3 of this invention will next be explained with reference to a flow chart shown in FIG. 6.

First, the charging-discharging control circuit 15A confirms the voltage of a DC bus 3 on the basis of a measuring value from the voltage measuring instrument 18. The charging-discharging control circuit 15A then confirms a regenerative state and a power running state of the elevator by this bus voltage, and judges whether the bus voltage exceeds a predetermined value or not (steps S301, S302). If bus voltage does not exceed the predetermined value, charging operation is not performed because the power running state is set. A gate ON time of the gate 13*b* for charging current control of the DC-DC converter 13 of the power accumulating device 11 is controlled and set to 0 (step S302→S303).

In contrast to this, when the bus voltage is higher than the predetermined value, a regenerative operation is performed. In this case, a control operation is performed such that the secondary battery 12 is charged. First, a charging degree SOC of the secondary battery 12 of the power accumulating device 11 is read from the charging-discharging state measuring device 14A, and a limited charging current corresponding to the charging degree SOC is calculated from the table T2 shown in FIG. 6 (step S302→S304, S305). In general, charging current is not efficiently received in a high charging degree SOC state. Accordingly, it is desirable to reduce and limit the charging current when the charging degree SOC exceeds a certain level.

Thereafter, it is judged whether the present charging current given from the charging-discharging state measuring device 14A exceeds the calculated limited charging current or not. If the present charging current does not exceed the limited charging current, an adjusting time DT is added to the present ON time and a new gate ON time of the gate 13*b* for charging current control is calculated, to further increase the charging current, so that an ON pulse width is increased (steps S306, S307).

In contrast to this, if the present charging current exceeds the limited charging current, the adjusting time DT is subtracted from the present ON time and a new gate ON time of the gate 13*b* for charging current control is calculated, so that the ON pulse width is narrowed, and the charging current is reduced (step S306→S308). Thus, ON control of the gate 13*b* for charging current control is performed on the basis of the calculated gate ON time, as well as storing the calculated gate ON time to a built-in memory as the present gate ON time to prepare for the next adjustment of the gate ON time (step S309).

Therefore, in accordance with the above embodiment mode 3, similar to the embodiment mode 1, when regenerative power is charged to the power accumulating device 11, stable charging control can be performed, by selecting the limited charging current according to the charging degree SOC, in a range in which no excessive burden is imposed on the secondary battery 12. Accordingly, a cheap power accumulating-device having high energy saving efficiency can be constructed.

Embodiment Mode 4

In this embodiment mode 4, the charging-discharging control circuit 15A controls the charging current supplied to the power accumulating device 11 on the basis of the comparison of a measuring value of the charging current and a maximum charging current set value.

Figure 8:
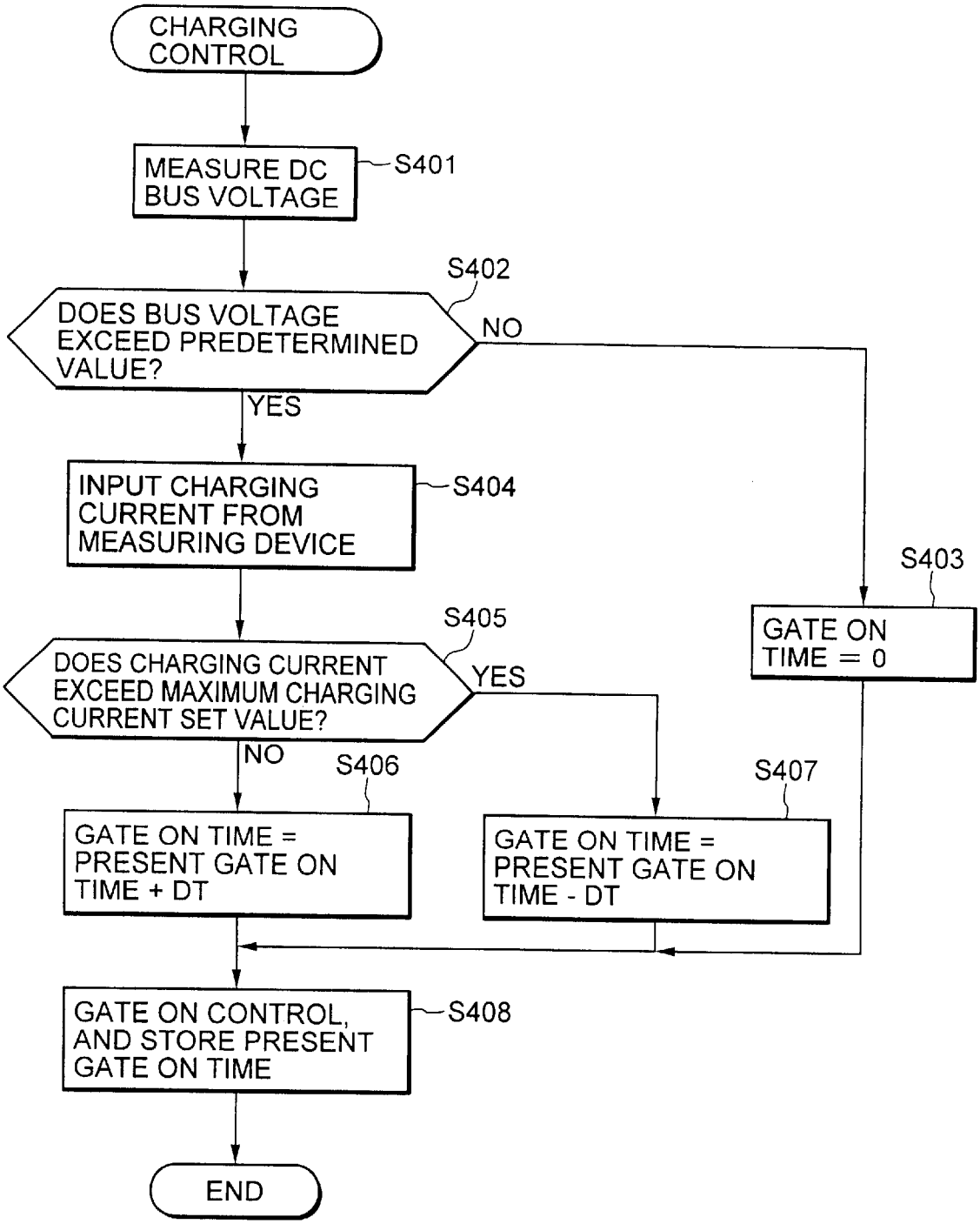
FIG. 8 is a flow chart showing charging control contents of a charging-discharging control circuit in an embodiment 4 of this invention.

Control of the charging-discharging control circuit 15A in the embodiment mode 4 of this invention will next be explained with reference to a-flow chart shown in FIG. 8.

First, the charging-discharging control circuit 15A confirms the voltage of a DC bus 3 on the basis of a measuring value from the voltage measuring instrument, 18. The charging-discharging control circuit 15A then confirms a regenerative state and a power running state of the elevator by this bus voltage, and judges whether the bus voltage exceeds a predetermined value or not (steps S401, S402). If bus voltage does not exceed the predetermined value, charging operation is not performed because the power running state is set. A gate ON time of the gate 13*b* for charging current control of the DC-DC converter 13 of the power accumulating device 11 is controlled and set to 0 (step S402→S403).

In contrast to this, when the bus voltage is higher than the predetermined value, a regenerative operation is performed. In this case, a control operation is performed such that the secondary battery 12 is charged. First, a charging current supplied to the secondary battery 12 of the power accumulating device 11 is read from the charging-discharging state measuring device 14A, and it is judged whether the present charging current exceeds a maximum charging current set value set in advance or not (step S402→S404, S405). If the present charging current does not exceed the maximum charging current set value, an adjusting time DT is added to the present ON time and a new gate ON time of the gate 13*b* for charging current control is calculated, to further increase the charging current, so that an ON pulse width is increased (step S406).

In contrast to this, if the present charging current exceeds the maximum charging current set value, the adjusting time DT is subtracted from the present ON time and a new gate ON time of the gate 13*b* for charging current control is calculated, so that the ON pulse width is narrowed, and the charging current is reduced (step S405→S407). Thus, ON control of the gate 13*b* for charging current control is performed on the basis of the calculated gate ON time, as well as storing the calculated gate ON time to a built-in memory as the present gate ON time to prepare for the-next adjustment of. the gate ON time (step S408).

Therefore, in accordance with the above embodiment mode 4, the charging current supplied to the power accumulating device 11 is controlled on the basis of the comparison of a measuring value of the charging current and the maximum charging current set value. Therefore, similar to the embodiment mode 1, when regenerative power is charged to the power accumulating device 11, stable charging control can be performed in a range in which no excessive burden is imposed on the secondary battery 12. Accordingly, a cheap power accumulating device having high energy saving efficiency can be constructed.

Embodiment Mode 5

In this embodiment mode 5, the charging-discharging control circuit 15A has a table T3 in which a maximum charging voltage with respect to a charging current of the secondary battery 12 of the power accumulating device 11 is set as shown in FIG. 9. The charging current and the charging voltage supplied to the secondary battery 12 of the power accumulating device 11 are inputted from the charging-discharging state measuring device 14A to the charging-discharging control circuit 15A. The charging-discharging control circuit 15A calculates the maximum charging voltage according to the charging current from the table T3. Further, the charging-discharging control circuit 15A controls the charging current supplied to the power accumulating device 11 on the basis of the comparison of a measuring value of the charging voltage from the above charging-discharging state measuring device 14A and the maximum charging voltage.

Figure 10:
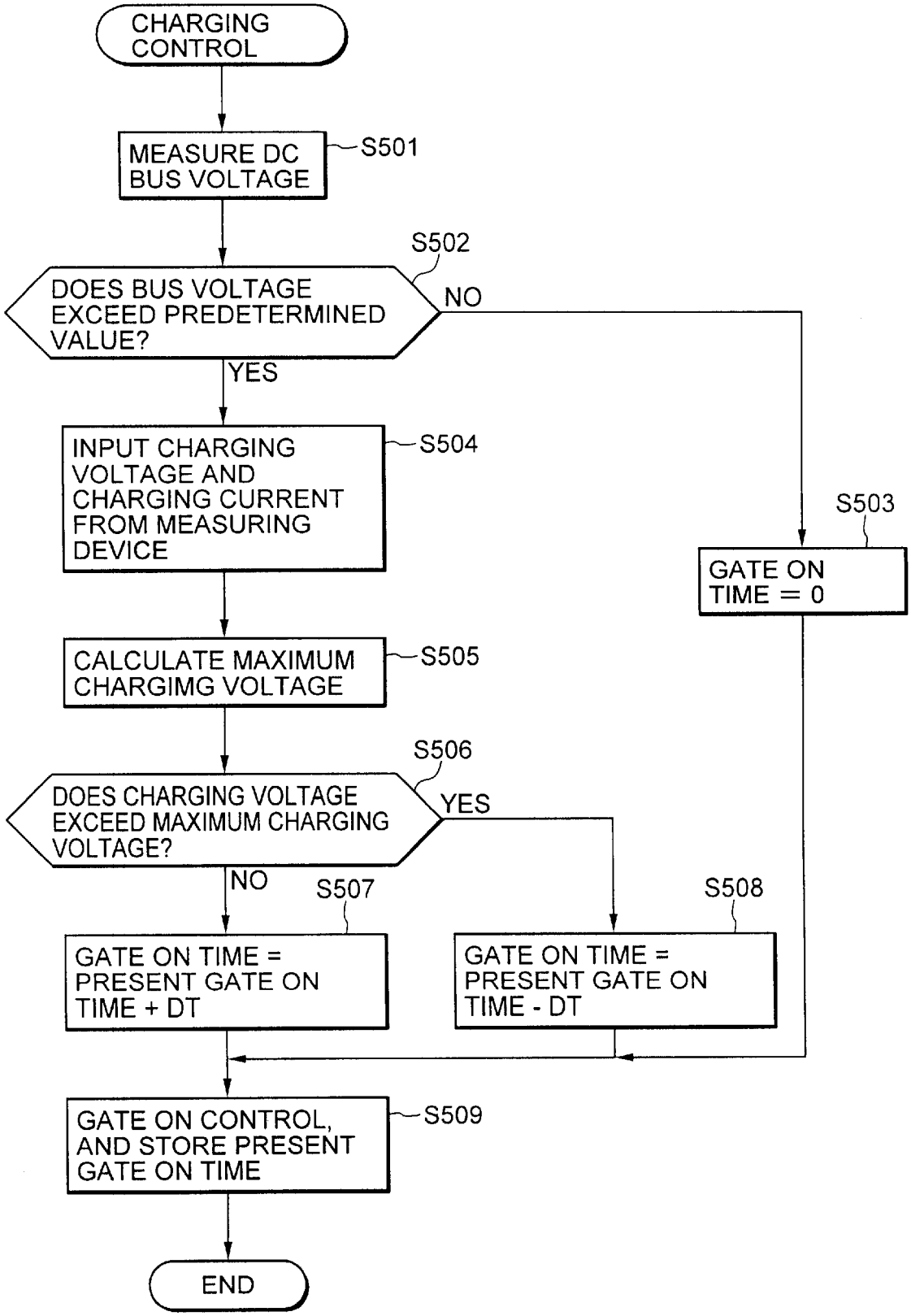
FIG. 10 is a flow chart showing charging control contents of the charging-discharging control circuit in the embodiment 5 of this invention.

Control of the charging-discharging control circuit 15A in the embodiment mode 5 of this invention will next be explained with reference to a flow chart shown in FIG. 10.

First, the charging-discharging control circuit 15A confirms the voltage of a DC bus 3 on the basis of a measuring value from the voltage measuring instrument 18. The charging-discharging control circuit 15A also confirms a regenerative state and a power running state of the elevator by this bus voltage, and judges whether the bus voltage exceeds a predetermined value or not (steps S501, S502). If bus voltage does not exceed the predetermined value, charging operation is not performed because the power running state is set. A gate ON time of the gate 13*b* for charging current control of the DC-DC converter 13 of the power accumulating device 11 is controlled and set to 0 (step S502→S503).

In contrast to this, when the bus voltage is higher than the predetermined value, a regenerative operation is performed. In this case, a control operation is performed such that the secondary battery 12 is charged. First, a charging current and a charging voltage supplied to the secondary battery 12 of the power accumulating device 11 are read from the charging-discharging state measuring device 14A. A maximum charging voltage corresponding to the charging current is calculated from the table T3 shown in FIG. 9 (step S502→S504, S505).

Thereafter, it is judged whether the present charging voltage given from the charging-discharging state measuring device 14A, exceeds the calculated maximum charging voltage or not. If the present charging voltage does not exceed the maximum charging voltage, an adjusting time DT is added to the present ON time and a new gate ON time of the gate 13*b* for charging current control is calculated, to further increase the charging current, so that an ON pulse width is increased (steps S506, S507).

In contrast to this, if the present charging voltage exceeds the maximum charging voltage, the adjusting time DT is subtracted from the present ON time and a new gate ON time of the gate 13*b* for charging current control is calculated, so that the ON pulse width is narrowed, and the charging current is reduced (step S506→S508). Thus, ON control of the gate 13*b* for charging current control is performed on the basis of the calculated gate ON time, as well as storing the calculated gate ON time to a built-in memory as the present gate ON time to prepare for the next adjustment of the gate ON time (step S509).

Therefore, in accordance with the above embodiment mode 5, the maximum charging voltage according to a measuring value of the charging current is calculated from a table, and the charging current supplied to the power accumulating device 11 is controlled on the basis of the comparison of a measuring value of the charging voltage and the maximum charging voltage. Therefore, similar to the embodiment mode 1, when regenerative power is charged to the power accumulating device 11, stable charging control can be performed in a range in which no excessive burden is imposed on the secondary battery 12. Accordingly, a cheap power accumulating device having high energy saving efficiency can be constructed.

Embodiment Mode 6

In this embodiment mode 6, a charging current and a charging voltage supplied to the secondary battery 12 of the power accumulating device 11 are inputted from the charging-discharging state measuring device 14A, and also speed commands are inputted from the speed control circuit 21 to the charging-discharging control circuit 15A. The charging-discharging control circuit 15A then controls a discharging current of the power accumulating device 11.

Figure 11:
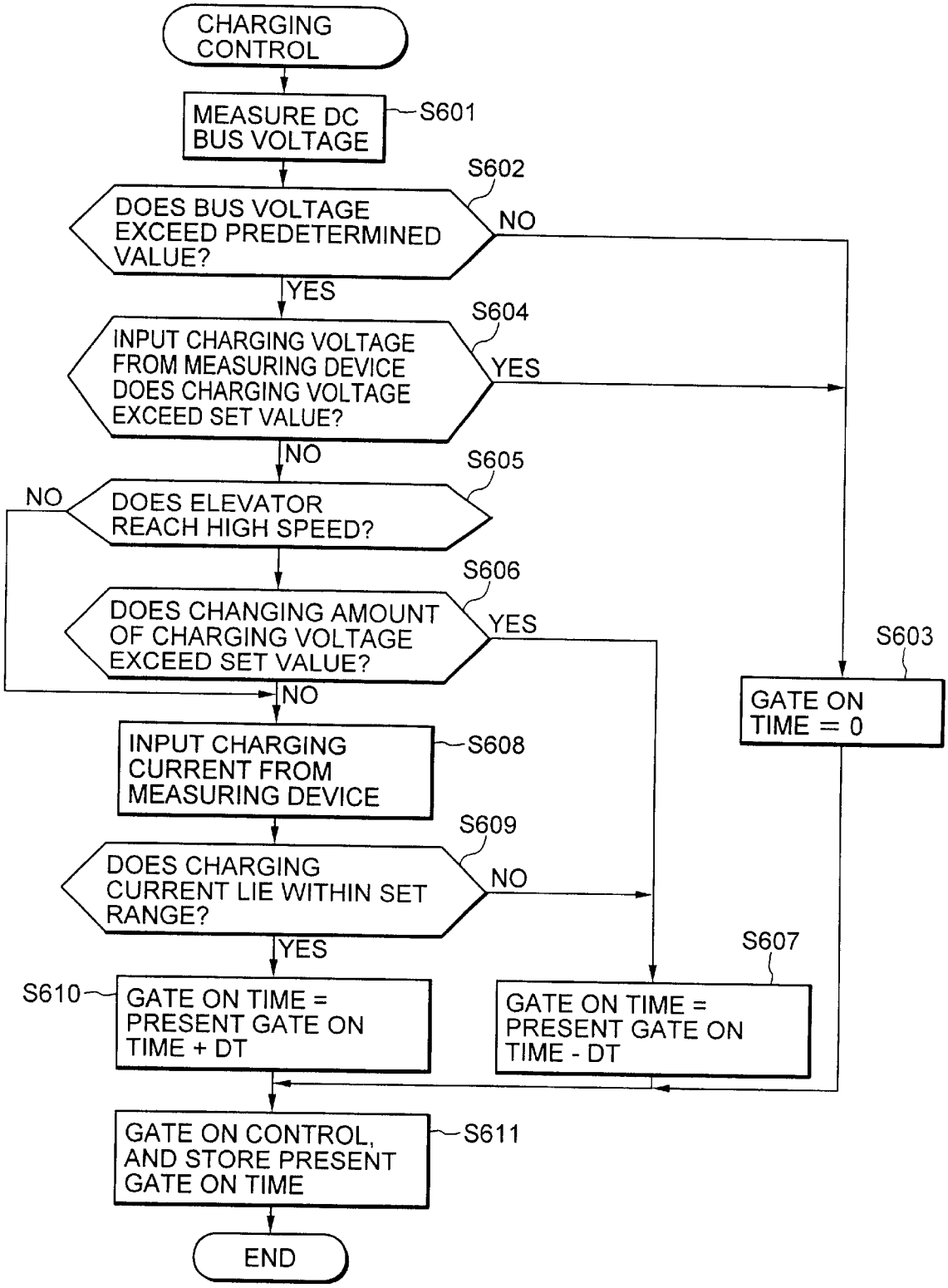
FIG. 11 is a flow chart showing charging control contents of a charging-discharging control circuit in an embodiment 6 of this invention.

Control of the charging-discharging control circuit 15A in the embodiment mode 6 of this invention will next be explained with reference to a flow chart shown in FIG. 11.

First, the charging-discharging control circuit 15A confirms the voltage of a DC bus 3 on the basis of a measuring value from the voltage measuring instrument 18. The charging-discharging control circuit 15A then confirms a regenerative state and a power running state of the elevator by this bus voltage, and judges whether the bus voltage exceeds a predetermined value or not (steps S601, S602). If no bus voltage exceeds the predetermined value, charging operation is not performed because the power running state is set. A gate ON time of the gate 13*b* for charging current control of the DC-DC converter 13 of the power accumulating device 11 is controlled and set to 0 (step S602→S603).

In contrast to this, when the bus voltage is higher than the predetermined value, a regenerative operation is performed. The charging voltage of the secondary battery 12 of the power accumulating device 11 is read from the charging-discharging state measuring device 14A and this charging voltage is judged whether it exceeds a predetermined value or not. If the charging voltage exceeds the predetermined value, no charging is required, and the gate ON time of the gate 13*b* for charging current control of the DC-DC converter 13 of the power accumulating device 11 is controlled and set to 0 (step S604→S603).

However, if the charging voltage does not exceed the predetermined value, a control operation is performed such that the secondary battery 12 is charged. In this case, it is first confirmed whether or not the elevator is running at a constant speed (acceleration is terminated) on the basis of speed commands from the speed control circuit 21. If the speed of the elevator reaches a high speed, the charging voltage is monitored. If there is an increment equal to or greater than a set value of the charging voltage, an adjusting time DT is subtracted from the present ON time and a new gate ON time of the gate 13*b* for charging current control is calculated, so that an ON pulse width is narrowed, and the charging current is reduced (steps S604 to S607).

At this time, if no operating state of the elevator is confirmed, there is a defect, when regenerative power itself at an accelerating time is increasing, the battery voltage at a charging time greatly increases, and this increase is detected. Therefore, it is necessary to check the operating state of the elevator. An incremental value of this voltage change is checked for the purpose of limiting charging in advance, before an absolute value of the voltage increases. The above charging voltage generally tends to be suddenly increases just before excessive charging is caused even when the same amount of an electric current is continuously flowing. Accordingly, if this change in voltage is measured, it is possible to perform a control operation in which charging is reduced and stopped, etc. at an early point in time.

When it is judged in the above step S605 that the elevator is not running at a constant speed (acceleration is not terminated), or when it is judged in the above step S606 that no changing amount of the charging voltage exceeds a set value, it is judged whether a measuring value of the charging current from the charging-discharging state measuring device 14A lies within a set range or not (step S605 or S606→S608, S609).

If the charging current does not lie within the set range in the above step S609, an adjusting time DT is subtracted from the present ON time and a new gate ON time of the gate 13*b* for charging current control is calculated, so that an ON pulse width is narrowed, and the charging current is reduced (step S609→S607).

In contrast to this, if the charging current lies within the set range, the adjusting time DT is added to the present gate ON time and a new gate ON time of the gate 13*b* for charging current control is calculated, to further increase the charging current, so that the ON pulse width is increased (steps S609, S610).

Thus, ON control of the gate 13*b* for charging current control is performed on the basis of the calculated gate ON time, as well as storing the calculated gate ON time to a built-in memory as the present gate ON time to prepare for the next adjustment of the gate ON time (step S611).

Therefore, in accordance with the above embodiment mode 6, the charging current supplied to the power accumulating device 11 is controlled on the basis of measuring values of the charging current and the charging voltage and speed commands. Therefore, similar to the embodiment mode 1, when regenerative power is charged to the power accumulating device 11, stable charging control can be performed in a range in which no excessive burden is imposed on the secondary battery 12. Accordingly, a cheap power accumulating device having high energy saving efficiency can be constructed.

Embodiment Mode 7

In this embodiment mode 7, the charging-discharging control circuit 15A has a table T4 in which a limited discharging current with respect to the temperature of the secondary battery 12 of the power accumulating device 11 is set as shown in FIG. 12. The temperature and the discharging current of the secondary battery 12 of the power accumulating device 11 are inputted from the charging-discharging state measuring device 14A to the charging-discharging control circuit 15A. The charging-discharging control circuit 15A then calculates the limited discharging current according to the battery temperature from the table T4. Further, the charging-discharging control circuit 15A controls the discharging current of the secondary battery 12 of the power accumulating device 11 on the basis of the comparison of a measuring value of the discharging current from the above charging-discharging state measuring device 14A and the limited discharging current.

Figure 13:
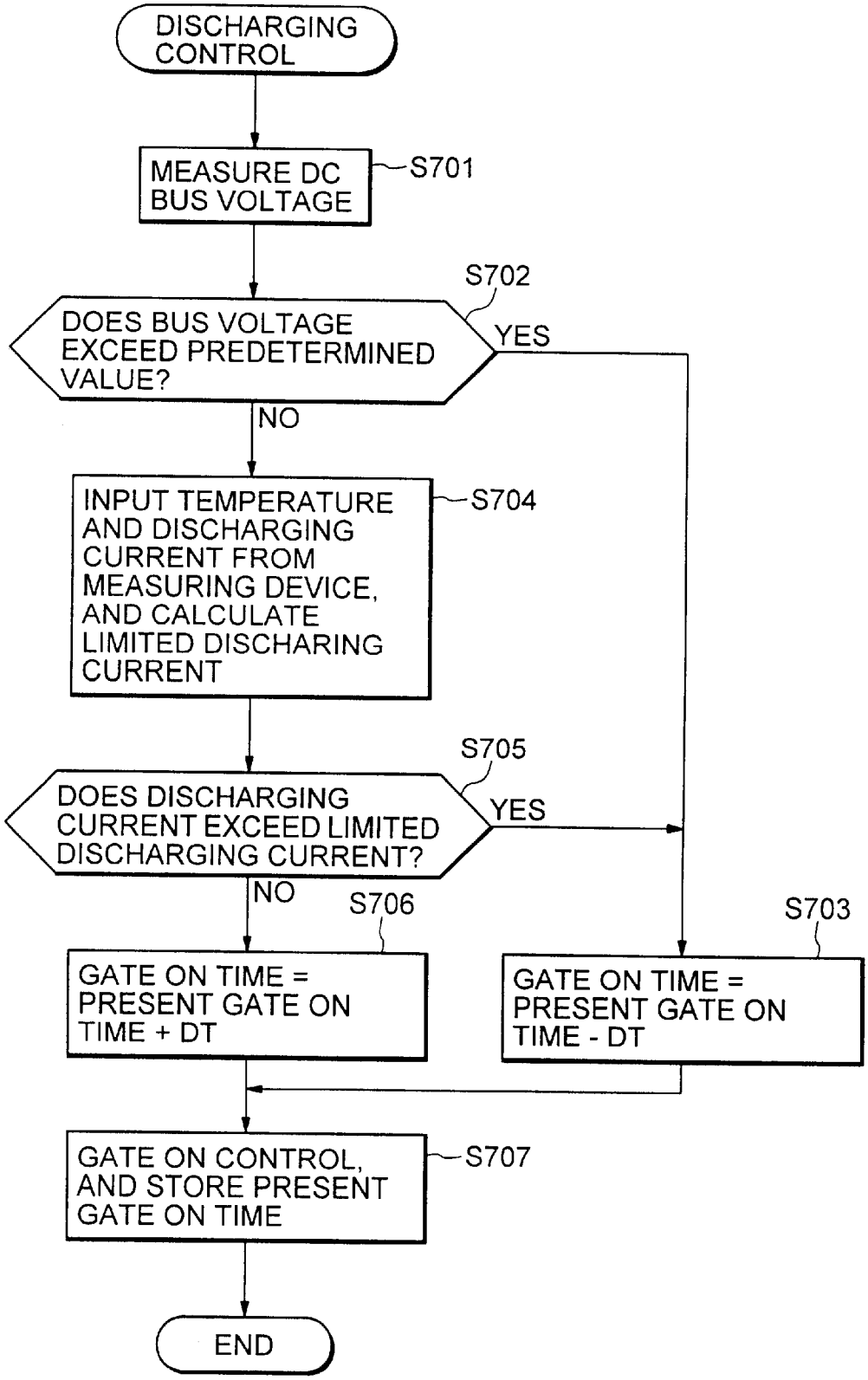
FIG 13. is a flow chart showing discharging control con-tents of the charging-discharging control circuit in the embodiment 7 of this invention.

Control of the charging-discharging. control circuit 15A in the embodiment mode 7 of this invention will next be explained with reference to a flow chart shown in FIG. 13.

First, the charging-discharging control circuit 15A confirms the voltage of a DC bus 3 on the basis of a measuring value from the voltage measuring instrument 18, and judges whether the bus voltage exceeds a predetermined value or not (steps S701, S702). If the bus voltage exceeds the predetermined value, an adjusting time DT is subtracted from the present gate ON time and a new gate ON time of the gate 13*d* for discharging current control is calculated, so that the ON pulse width is narrowed, and the discharging current is reduced (step S702→S703).

In contrast to this, if no bus voltage exceeds the predetermined value, the temperature and the discharging current of the secondary battery 12 of the power accumulating device 11 are read from the charging-discharging state measuring device 14A, and the limited discharging current corresponding to the battery temperature. is calculated from the table T4, and it is judged whether the present discharging current exceeds the limited discharging current or not (step S702→S704, S705). If the present discharging current exceeds the limited discharging current, the adjusting time DT is subtracted from the present gate ON time and a new gate ON time of the gate 13*d* for discharging current control is calculated, so that the ON pulse width is narrowed, and the discharging current is reduced (step S705→S703).

In contrast to this, when no present discharging current exceeds the limited discharging current, the adjusting time DT is added to the present gate ON time and a new gate ON time of the gate 13*d* for discharging current control is calculated, to further increase the discharging current, so that the ON pulse width is increased (step S706). Thus, ON control of the gate 13*d* for discharging current control is performed on the basis of the calculated gate ON time, as well as storing the calculated gate ON time to a built-in memory as the present gate ON time to prepare for the next adjustment of the gate ON time (step S707).

Therefore, in accordance with the above embodiment mode 7, a corresponding limited discharging current is calculated from the table on the basis of a measuring value of the battery temperature, and the discharging current supplied to the power accumulating device 11 is controlled on the basis of the comparison of a measuring value of the discharging current. and the limited discharging current. Therefore, when the power accumulating device 11 is discharged, stable discharging control can be performed in a range in which no excessive burden is imposed on the secondary battery 12. Accordingly, a cheap power accumulating device having high energy saving efficiency can be constructed.

Embodiment Mode 8

Figure 14:
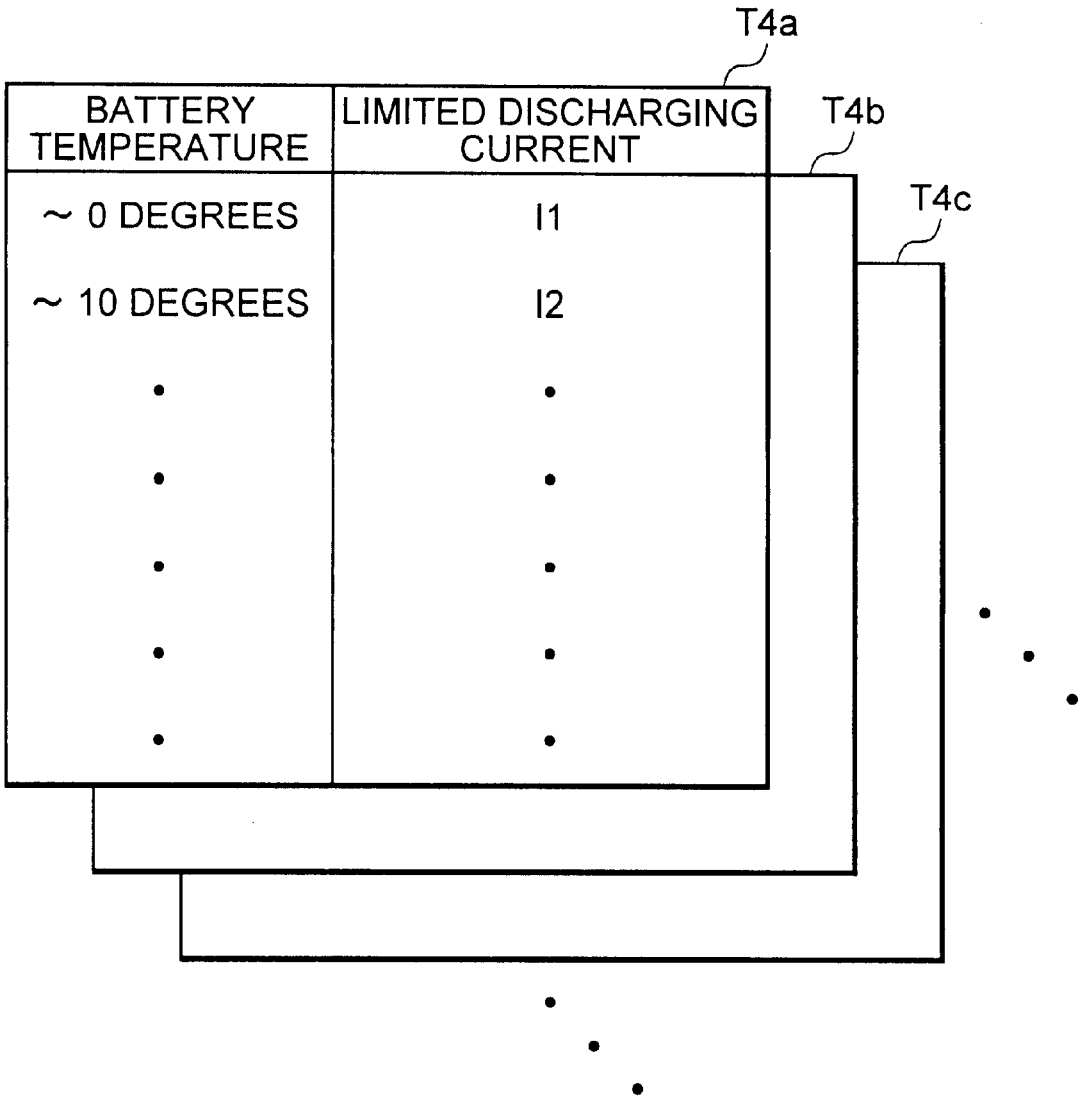
FIG. 14 is an explanatory view of a table in a charging-discharging control circuit in an embodiment 8 of this invention.

In this embodiment mode 8, as shown in FIG. 14, the charging-discharging control circuit 15A has plural tables T4*a*, T4*b*, T4*c*, . . . in which a limited discharging current with respect to temperature is set, in accordance with a charging degree SOC of the secondary battery 12 of the power accumulating device 11. The temperature, the discharging current and the charging degree SOC of the secondary battery 12 of the power accumulating device 11 are inputted from the charging-discharging state measuring device 14A to the charging-discharging control circuit 15A. The charging-discharging control circuit 15A then selects a table according to the charging degree SOC from the plural tables, and calculates the limited discharging current according to the battery temperature from the selected table. Further, the charging-discharging control circuit 15A controls the discharging current of the secondary battery 12 of the power accumulating device 11 on the basis of the comparison of a measuring value of the discharging current from the above charging-discharging state measuring device 14A and the limited discharging current.

Figure 15:
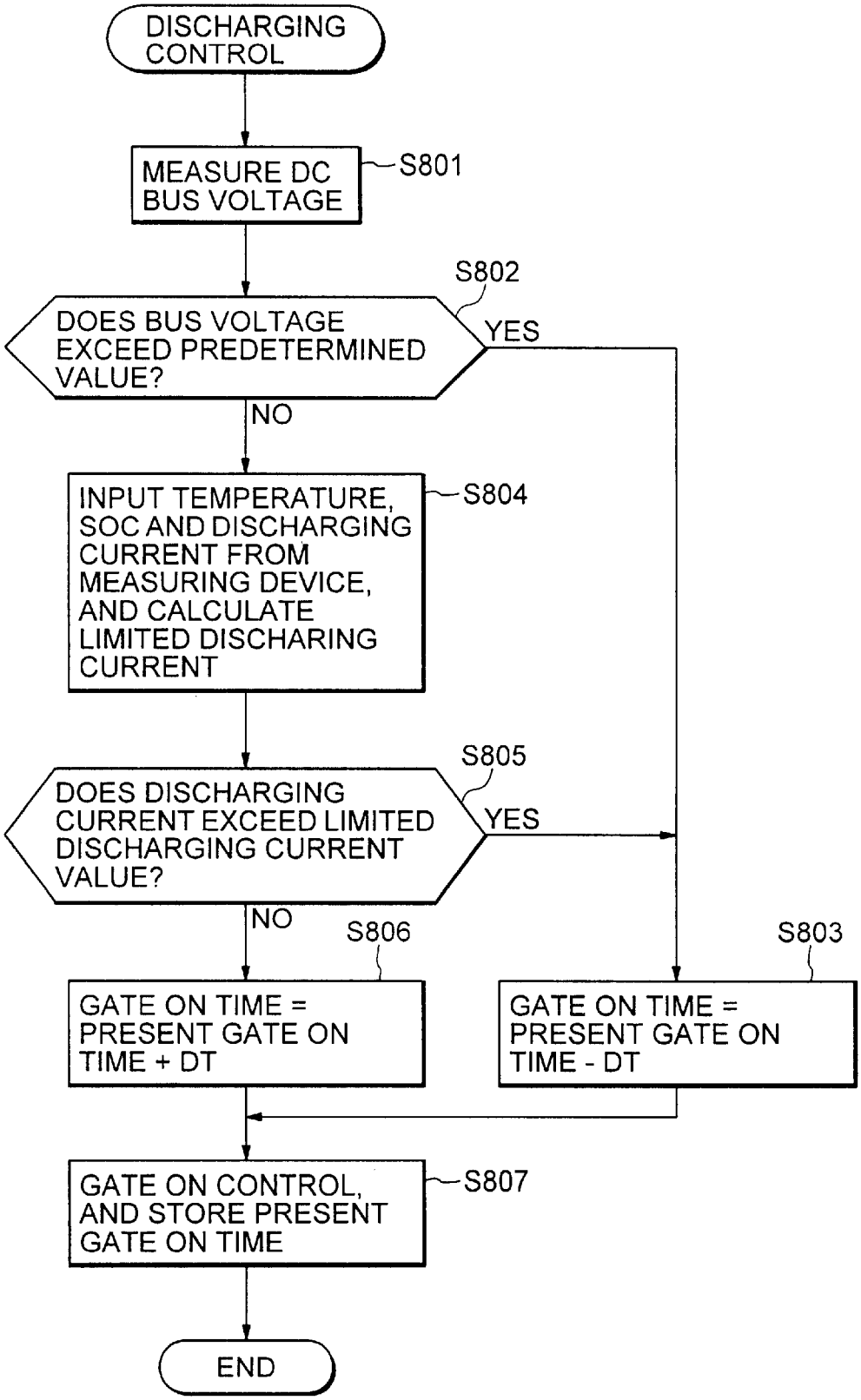
FIG. 15 is a flow chart showing discharging control contents of the charging-discharging control circuit in the embodiment 8 of this invention.

Control of the charging-discharging control circuit 15A in the embodiment mode 8 of this invention will next be explained with reference to a flow chart shown in FIG. 15.

First, the charging-discharging control circuit 15A confirms the voltage of a DC bus 3 on the basis of a measuring value from the voltage measuring instrument 18, and judges whether the bus voltage exceeds a predetermined value or not (steps S801, S802). If the bus voltage exceeds the predetermined value, an adjusting time DT is subtracted from the present gate ON time and a new gate ON time of the gate 13*d* for discharging current control is calculated, so that the ON pulse width is narrowed, and the discharging current is reduced (step S802→S803).

In contrast to this, if bus voltage does not exceed the predetermined value, the temperature, the discharging current and the charging degree SOC of the secondary battery 12 of the power accumulating device 11 are read from the charging-discharging state measuring device 14A, and a table according to the charging degree SOC is selected from the plural tables shown in FIG. 14. A limited discharging current corresponding to the battery temperature is calculated from the selected table, and it is judged whether the present discharging current exceeds the limited discharging current or not (step S802→S804, S805). If the present discharging current exceeds the limited discharging current, the adjusting time DT is subtracted from the present gate ON time and a new gate ON time of the gate 13*d* for discharging current control is calculated so that the ON pulse width is narrowed and the discharging current is reduced (step S805→S803).

In contrast to this, when present discharging current does not exceed the limited discharging current, the adjusting time DT is added to the present gate ON time and a new gate ON time of the gate 13*d* for discharging current control is calculated, to further increase the discharging current, so that the ON pulse width is increased (step S806). Thus, ON control of the gate 13*d* for discharging current control is performed on the basis of the calculated gate ON time, as well as storing the calculated gate ON time to a built-in memory as the present gate ON time to prepare for the next adjustment of the gate ON time (step S807).

Therefore, in accordance with the above embodiment mode 8, a table according to the charging degree SOC is selected, and the limited discharging current according to the battery temperature is calculated from the selected table. The discharging current supplied to the power accumulating device 11 is controlled on the basis of the comparison of a measuring value of the discharging current and the limited discharging current. Therefore, when the power accumulating device 11 is discharged, stable discharging control can be performed in a range in which no excessive burden is imposed on the secondary battery 12. Accordingly, a cheap power accumulating device having high energy saving efficiency can be constructed.

Embodiment Mode 9

In this embodiment mode 9, the charging-discharging control circuit 15A has a table T5 in which a limited discharging current with respect to a charging degree SOC of the secondary battery 12 of the power accumulating device 11 is set, as shown in FIG. 16. The discharging current and the charging degree SOC of the secondary battery 12 of the power accumulating device 11 are inputted from the charging-discharging state measuring device 14A to the charging-discharging control circuit 15A. The charging-discharging control circuit 15A then calculates the limited discharging current according to the charging degree SOC from this table. Further, the charging-discharging control circuit 15A controls the discharging current of the secondary battery 12 of the power accumulating device 11 on the basis of the comparison of a measuring value of the discharging current from the above charging-discharging state measuring device 14A and the limited discharging current.

Figure 17:
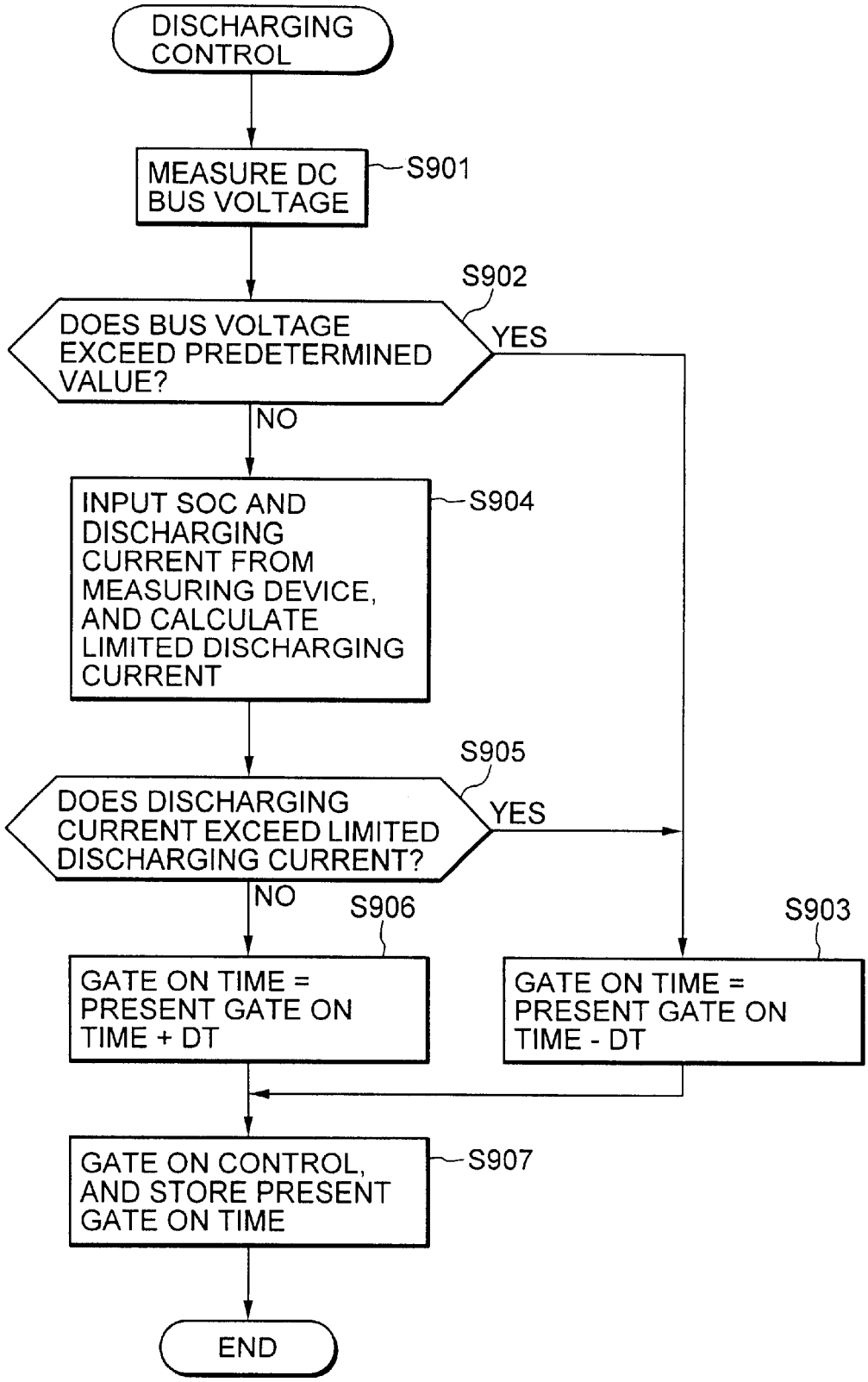
FIG. 17 is a flow chart showing discharging control contents of the charging-discharge discharging control circuit in the embodiment 9 of this invention.

Control of the charging-discharging control circuit 15A in the embodiment mode 9 of this invention will next be explained with reference to a flow chart shown in FIG. 17.

First, the charging-discharging control circuit 15A confirms the voltage of a DC bus 3 on the basis of a measuring value from the voltage measuring instrument 18, and judges whether the bus voltage exceeds a predetermined value or not (steps S901, S902). If the bus voltage exceeds the predetermined value, an adjusting time DT is subtracted from the present gate ON time and a new gate ON time of the gate 13*d* for discharging current control is calculated, so that the ON pulse width is narrowed, and the discharging current is reduced (step S902→S903).

In contrast to this, if no bus voltage exceeds the predetermined value, the discharging current and the charging degree SOC of the secondary battery 12 of the power accumulating device 11 are read from the charging-discharging state measuring device 14A, and the limited discharging current according to the charging degree SOC is calculated from the table shown in FIG. 16, and it is judged whether the present discharging current exceeds the limited discharging current or not (step S902→S904, S905. If the present discharging current exceeds the limited discharging current, the adjusting time DT is subtracted from the present gate ON time and a new gate ON time of the gate 13*d* for discharging current control is calculated, so that the ON pulse width is narrowed, and the discharging current is reduced (step S905→S903).

In contrast to this, when no present discharging current exceeds the limited discharging current, the adjusting time DT is added to the present gate ON time and a new gate ON time of the gate 13*d* for discharging current control is calculated, to further increase the discharging current, so that the ON pulse width is increased (step S906). Thus, ON control of the gate 13*d* for discharging current control is performed on the basis of the calculated gate ON time, as well as storing the calculated gate ON time to a built-in memory as the present gate ON time to prepare for the next adjustment of the gate ON time (step S907).

Therefore, in accordance with the above embodiment mode 9, the limited discharging current according to the charging degree SOC is calculated and the discharging current supplied to the power accumulating device 11 is controlled on the basis of the comparison of a measuring value, of the discharging current and the limited discharging current. Therefore, when the power accumulating device 11 is. discharged, stable discharging control can be performed in a range in which no excessive burden is imposed on the secondary battery 12. Accordingly, a cheap power accumulating device having high energy saving efficiency can be constructed.

Embodiment Mode 10

In this embodiment mode 10, the charging-discharging control circuit 15A has a table T6 in which a maximum discharging voltage with respect to a discharging current of the secondary battery 12 of the power accumulating device 11 is set as shown in FIG. 18. The discharging current and the discharging voltage of the secondary battery 12 of the power accumulating device 11 are inputted from the charging-discharging state measuring device 14A to the charging-discharging control circuit 15A. The charging-discharging control circuit 15A calculates the maximum discharging voltage according to the discharging current from this table. Further, the charging-discharging control circuit 15A controls the discharging current of the secondary battery 12 of the power accumulating device 11 on the basis of the comparison of a measuring value of the discharging voltage from the above charging-discharging state measuring device 14A and the maximum discharging voltage.

Figure 19:
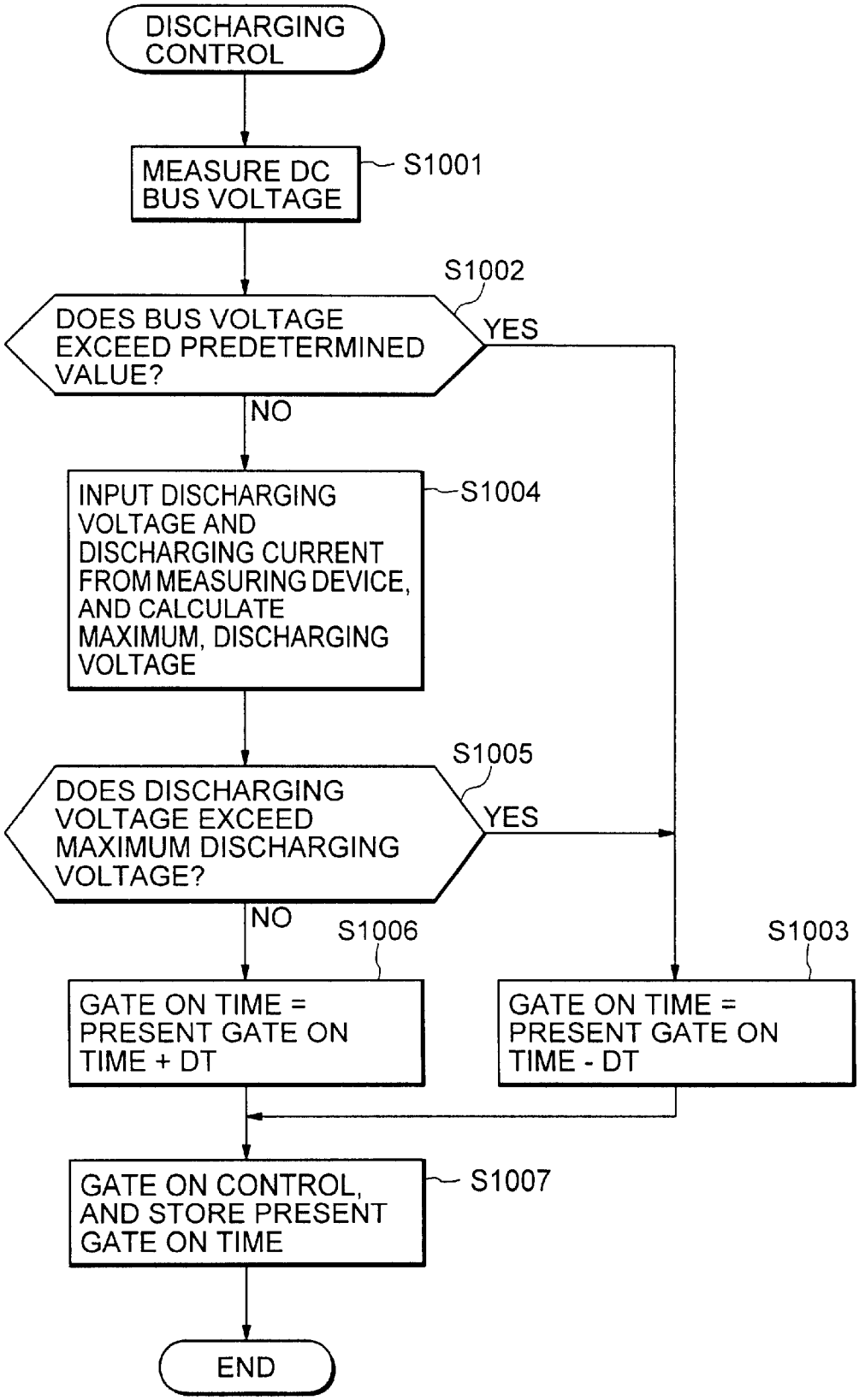
FIG. 19 is a flow chart showing discharging control contents of the charging-discharging control circuit in the embodiment 10 of this invention.

Control of the charging-discharging. control circuit 15A in the embodiment mode 10 of this invention will next be explained with reference to a flow chart shown in FIG. 19.

First, the charging-discharging control circuit 15A confirms the voltage of a DC bus 3 on the basis of a measuring value from the voltage measuring instrument 18, and judges whether the bus voltage exceeds a predetermined value or not (steps S1001, S1002). If the bus voltage exceeds the predetermined value, an adjusting time DT is subtracted from the present gate ON time and a new gate ON time of the gate 13*d* for discharging current control is calculated, so that the ON pulse width is narrowed, and the discharging current is reduced (step S1002→S1003).

In contrast to this, if no bus voltage exceeds the predetermined value, the discharging current and the discharging voltage of the secondary battery 12 of the power accumulating device 11 are read from the charging-discharging state measuring device 14A, and a maximum discharging voltage according to the discharging current is calculated from the table shown in FIG. 18, and it is judged whether the present discharging voltage exceeds the maximum discharging voltage or not (step S1002→S1004, S1005). If the present discharging voltage exceeds the maximum discharging voltage, the adjusting time DT is subtracted from the present gate ON time and a new gate ON time of the gate 13*d* for discharging current control is calculated, so that the ON pulse width is narrowed, and the discharging current is reduced (step S1005→S1003).

In contrast to this, when no present discharging voltage exceeds the maximum discharging voltage, the adjusting time DT is added to the present gate ON time and a new gate ON time of the gate 13*d* for discharging current control is calculated, to further increase the discharging current, so that the ON pulse width is increased (step S1006). Thus, ON control of the gate 13*d* for discharging current control is performed on the basis of the calculated gate ON time, as well as storing the calculated gate ON time to a built-in memory as the present gate ON time to prepare for the next adjustment of the gate ON time (step S1007).

Therefore, in accordance with the above embodiment mode 10, a maximum discharging voltage according to the discharging current is calculated from a table, and the discharging current supplied to the power accumulating device 11 is controlled on the basis of the comparison of a measuring value of the discharging voltage and the maximum discharging voltage. Therefore, when the power accumulating device 11 is discharged, stable discharging control can be performed in a range in which no excessive burden is imposed on the secondary battery 12. Accordingly, a cheap power accumulating device having high energy saving efficiency can be constructed.

As mentioned above, in accordance with this invention, stable charging-discharging control of the power accumulating device can be performed, by controlling charging and discharging operations of the power accumulating device according to a measuring value from a bus voltage measuring means and a measuring value from a charging-discharging state measuring means. It is possible to construct an elevator having a power accumulating device with a long battery life without reducing energy saving effects even when a cheap secondary battery of a small capacity is used.

What is claimed is:

1. A controller for dynamically allocating delivery of regenerative power to a rechargeable power supply of an elevator system comprising:

a converter for rectifying AC power of an AC power source to DC power;

an inverter for converting the DC power to AC power having a variable voltage and a variable frequency for driving an electric motor to operate an elevator during powered operation of the elevator;

DC buses connecting said converter to said inverter;

a power accumulating device connected across said DC buses and accumulating DC power from the DC buses during regenerative operation of the elevator and supplying DC power to the DC buses during powered operation of the elevator;

bus voltage measuring means for measuring bus voltage across said DC buses;

charging-discharging control means for controlling charging and discharging of said power accumulating device with respect to said DC buses and receiving the bus voltage from said bus voltage measuring means; and charging-discharging state measuring means for measuring state of charge of said power accumulating device, charging and discharging currents of said power accumulating device, charging and discharging voltages of said power accumulating device, and temperature of said power accumulating device, said charging-discharging control means controlling the charging and discharging of said power accumulating device according to the bus voltage measured by said bus. voltage measuring means and at least one measured value measured by said charging-discharging state measuring means.

2. The controller according to claim 1, wherein, said charging-discharging control means includes a memory storing a table, the table establishing a charging current limit with respect to the temperature of said power accumulating device, and said control means controls the charging current supplied to said power accumulating device based on comparison of the charging current measured by said charging-discharging state measuring means and the charging current limit.

3. The controller according to claim 2, wherein said memory stores plural tables, each table corresponding to a charging degree obtained by normalizing and accumulating products of charging and discharging currents and charging and discharging voltages, with a fully charged state of said power accumulating device as a reference, and said control means selects a table according to charging degree of said power accumulating device.

4. The controller according to claim 1, wherein said charging-discharging control means includes a memory storing a table in which a charging current limit is set with respect to charging degree obtained by normalizing and accumulating products of charging and discharging currents and charging and discharging voltages, with a fully charged state of said power accumulating device as a reference, and said charging-discharging control means calculates the charging current limit corresponding to the charging degree based on a value measured by said charging-discharging state measuring means, and controls the charging current supplied to said power accumulating device based on comparison of the charging current measured and the charging current limit.

5. The controller according to claim 1, wherein said charging-discharging control means controls charging current supplied to said power accumulating device based on comparison of the charging current measured by said charging-discharging state measuring means and a maximum charging current.

6. The controller according to claim 1, wherein said charging-discharging control circuit includes a memory storing a table establishing a maximum charging voltage with respect to a charging current, and calculates a maximum charging voltage corresponding to a charging current measured by said charging discharging state measuring means, and controls the charging current supplied to said power accumulating device based on comparison of the charging voltage measured. and the maximum charging voltage.

7. The controller according to claim 1, further comprising speed control means for controlling speed of the elevator by controlling the variable voltage and the variable frequency of the AC power from said inverter, and said charging-discharging control means controls discharging current of said power accumulating device based on the bus voltage measured by said bus voltage measuring means, a value measured by said charging-discharging state measuring means, and speed commands from said speed control means.

8. The controller according to claim 1, wherein said charging-discharging control means includes a memory storing a table establishing a discharging current limit with respect to the temperature of said power accumulating device, and calculates the discharging current limit corresponding to temperature measured by said charging-discharging state measuring means, and controls the discharging current supplied to said power accumulating device based on comparison of the discharging current measured and the discharging current limit.

9. The controller according to claim 8, wherein said memory stores plural tables, each table corresponding to a charging degree obtained by normalizing and accumulating products of charging and discharging currents and charging and discharging voltages, with a fully charged state of said power accumulating device as a reference, and said control means selects a table according to charging degree of said power accumulating device based on a value measured by said charging-discharging state measuring means.

10. The controller according to claim 1, wherein said charging-discharging control means includes a memory storing a table in which a discharging current limit is set with respect to a charging degree obtained by normalizing and accumulating products of charging and discharging currents and charging and discharging voltages, with a fully charged state of said power accumulating device as a reference, and said charging-discharging control means calculates the discharging current limit corresponding to the charging degree based on a value measured by said charging-discharging state measuring means, and controls the discharging current supplied by said power accumulating device based on comparison of the discharging current measured and the discharging current limit.

11. The controller according to claim 1, wherein said charging-discharging control means includes a memory storing a table establishing a maximum discharging voltage with respect to a discharging current, and calculates a maximum discharging voltage corresponding to a discharging current measured by said charging-discharging state measuring means, and controls the discharging current supplied to said power accumulating device based on comparison of discharging voltage measured and the maximum discharging voltage.

* * * * *